US011331562B2

(12) United States Patent
Titelius

(10) Patent No.: US 11,331,562 B2
(45) Date of Patent: May 17, 2022

(54) GAME APPARATUS

(71) Applicant: JAMES T. HOLDINGS PTY LTD, East Fremantle (AU)

(72) Inventor: Aaron Titelius, East Fremantle (AU)

(73) Assignee: JAMES T. HOLDINGS PTY LTD, East Fremantle (AU)

( * ) Notice: Subject to any disclaimer, the term of this patent is extended or adjusted under 35 U.S.C. 154(b) by 0 days.

(21) Appl. No.: 16/956,422

(22) PCT Filed: Dec. 18, 2018

(86) PCT No.: PCT/AU2018/051352

§ 371 (c)(1),
(2) Date: Jun. 19, 2020

(87) PCT Pub. No.: WO2019/119032

PCT Pub. Date: Jun. 27, 2019

(65) Prior Publication Data

US 2021/0093944 A1 Apr. 1, 2021

(30) Foreign Application Priority Data

Dec. 20, 2017 (AU) ..... 2017905103
Sep. 18, 2018 (AU) ..... 2018903512

(51) Int. Cl.
*A63F 3/00* (2006.01)
*A63F 11/00* (2006.01)

(52) U.S. Cl.
CPC ..... *A63F 3/00261* (2013.01); *A63F 3/00697* (2013.01); *A63F 11/0002* (2013.01);
(Continued)

(58) Field of Classification Search
CPC ..... A63F 3/00261; A63F 3/00697; A63F 11/0002; A63F 2003/00406;
(Continued)

(56) References Cited

U.S. PATENT DOCUMENTS 5,149,101 A 9/1992 Mazza et al.
6,428,003 B1 * 8/2002 Fondin ..... A63F 3/00094 273/241

(Continued)

OTHER PUBLICATIONS

International Search Report and Written Opinion dated Mar. 25, 2019, for PCT/AU2018/051352.

(Continued)

*Primary Examiner* — Michael D Dennis
(74) *Attorney, Agent, or Firm* — Bryan D. Zerhusen; Nicholas R. Herrel; Cantor Colburn LLP

(57) ABSTRACT

A game apparatus is disclosed that comprises a plurality of tokens including first tokens and second tokens, a frame arranged to define multiple pathways along which the tokens can move under force of gravity, and a retainer arranged to controllably retain the tokens relative to the pathways. The retainer is movable between a first position wherein the retainer retains the tokens relative to the pathways, and a second position wherein the tokens can move under force of gravity. The game apparatus also includes a separating mechanism arranged to direct the first tokens towards a first collection zone and to direct the second tokens towards a second collection zone. The separating mechanism comprises a first separating component associated with each first token and at least one second separating component associated with the frame.

14 Claims, 19 Drawing Sheets

(52) U.S. Cl.
CPC ..... *A63F 2003/00406* (2013.01); *A63F 2003/00703* (2013.01); *A63F 2011/0006* (2013.01)

(58) Field of Classification Search
CPC .... A63F 2003/00703; A63F 2011/0006; A63F 2003/007
See application file for complete search history.

(56) References Cited

U.S. PATENT DOCUMENTS

| | | | | |
|---|---|---|---|---|
| 7,810,814 | B1 | 10/2010 | Chapman et al. | |
| 2010/0096806 | A1 | 4/2010 | Hextall et al. | |
| 2016/0107072 | A1 | 4/2016 | Twigg | |
| 2019/0201780 | A1* | 7/2019 | Jang ..... | G09B 19/22 |

OTHER PUBLICATIONS

'I&K ELC Cotton Reels Threading Activity' [Viewed on internet on Mar. 14, 2019] URL:https://www.youtube.com/watch?v=QMYCsnjB9Fk>, Published on Nov. 22, 2015, Whole video https://www.youtube.com/watch?v=QMYCsnjB9Fk.

Lego Lilac Car Building Instructions—Lego Bricks and More Pink Brick Box 4625 "How To" [Viewed on internet on Mar. 14, 2019] <https://www.youtube.com/watch?v=H48ytVV7VUo>, Published on Sep. 9, 2015, whole video, 1:57-2: 17 https://www.youtube.com/watch?v=H48ytVV7VUo.

'Shiny Gold & silver Coin display stand I Phoenix Challenge Coins', [Viewed on internet on Mar. 14, 2019] <https://web.archive.org/web/20150907224918/https :// phoenixchallengecoins.com/shop/2-shiny-gold-single-challenge-coin-vertical-display-stand/> Published Sep. 7, 2015.

Plastic Stands I Fireside Games I bring fun home [Viewed on internet on Mar. 14, 2019] <https://web.archive.org/web/20 1 70503 1 24820/http://firesidegames.com/product/plastic-stands-for-board-game-tokens/, Published May 3, 2017.

* cited by examiner

GAME APPARATUS

RELATED APPLICATIONS

This application is a National Stage Patent Application of PCT/AU2018/051352, filed Dec. 18, 2018, titled: A GAME APPARATUS, which claims the benefit and priority to Australian Patent Application No. 2018903512, filed on Sep. 18, 2018, and Australian Patent Application No. 2017905103, filed on Dec. 20, 2017, both of which are incorporated herein by reference in their entirety for all purposes.

TECHNICAL FIELD

The present invention relates to a game apparatus.

BACKGROUND

Games that use at least two sets of visually distinct tokens have been in existence for centuries. The tokens are typically divided into two sets: a set of first tokens to be used by a first player, and a set of second tokens to be used by a second player. Examples of such games include "Go" and CONNECT FOUR®. Traditionally, the tokens are received in a frame or on a board that defines specific token placement areas for game play.

SUMMARY

According to a first aspect of the invention, there is provided a game apparatus comprising:

- a plurality of tokens including first tokens and second tokens;
- a frame arranged to define multiple pathways along which the tokens are capable of moving under force of gravity;
- a retainer arranged to controllably retain the tokens relative to the pathways, the retainer movable between:
  - (a) a first position wherein the retainer retains the tokens relative to the pathways; and
  - (b) a second position wherein the tokens are allowed to move under force of gravity; and
- a separating mechanism arranged to direct the first tokens towards a first collection zone and to direct the second tokens towards a second collection zone, the separating mechanism comprising a first separating component associated with each first token and at least one second separating component associated with the frame,
- wherein when the retainer is in the second position, the first and second separating components cooperate to direct the first tokens away from the second collection zone and towards the first collection zone.

Advantageously, by providing a separating mechanism, the first tokens can be automatically separated from the second tokens after game play. Accordingly, embodiments of the present invention may provide the advantage over traditional versions of the game CONNECT FOUR® of circumventing the need to manually sort tokens. This may reduce the length of time from the start of a game to the start of a next game by up to about 25%.

The first and second separating components may be configured as complementary engagement portions of the first tokens and the frame, respectively.

The frame may be arranged to define a plurality of substantially vertically oriented channels arranged side by side, wherein each channel comprises at least one pathway.

Each second separating component may comprise a pair of opposing guides associated with a respective channel, the pair of opposing guides configured to engage the first tokens in a manner that allows the first tokens to move along the pair of opposing guides by force of gravity.

Each pair of opposing guides may comprise a portion that extends along the respective channel.

Each pair of opposing guides may comprise opposing rails, and each first token may comprise a circumferential groove engageable with the opposing rails.

Alternatively, each pair of opposing guides may comprise opposing grooves, and each first token may comprise a circumferential ridge engageable with the opposing grooves.

The pair of opposing guides may comprise a sloped portion extending towards the first collection zone so that the first tokens can move under force of gravity to the first collection zone.

The sloped portion may transition from a generally vertical orientation to a generally horizontal orientation towards the first collection zone, such that the first tokens transition to a generally horizontal orientation while moving along the sloped portion.

The sloped portion may comprise an end located above a token stacking region, wherein a first token may be capable of falling off the end of the sloped portion and onto the token stacking region in a substantially horizontal orientation, and subsequent first tokens may be capable of falling off the end of the sloped portion and stacking on top of the first token already in the stacking region.

The token stacking region may comprise a sloped bed on top of which the first tokens are stacked.

The separating mechanism may comprise at least one third separating component associated with the frame, the third separating component arranged to cooperate with the second tokens so as to direct the second tokens to the second collection zone.

Each third separating component may comprise a pair of opposing guides.

Each second token may also comprise the first separating component, wherein the first separating component of each second token and the at least one third separating component may be configured as complementary engagement portions.

Each third separating component may comprise a pair of opposing rails and each second token comprises a circumferential groove engageable with the opposing rails.

The apparatus may comprise a common engagement portion defined between the second separating component and a third separating component in the same channel, wherein a portion of a first token engaged with the second separating component engages the common engagement portion, and a portion of a second token engaged with the third second separating component engages the common engagement portion, so as to enable stacking of the first and second token within the same channel.

In an embodiment, the first and second tokens may be structurally different, and the second tokens may be configured to be incapable of engaging the at least one second separating component. Each third separating component may be located underneath a respective channel to catch and direct the second tokens towards the second collection zone. Each third separating component may comprise a pair of sloped opposing rails and each second token comprises a circumferential ridge arranged to be received by the pair of opposing rails to direct the second tokens to the second collection zone. While within the same channel, the first and second tokens may move along the same pathway.

Alternatively, each second separating component may comprise a single guide rail defining a pathway along which the first and second tokens can move. The first separating component may comprise a recess in a face of each first and second token, the recess capable of engaging the single guide rail.

In an embodiment, the first and second tokens are structurally the same, and the game apparatus is arranged to guide first tokens such that the first tokens engage with the second separating component and to guide second tokens such that the second tokens do not engage with the second separating component.

In an embodiment, a third separating component is located underneath a respective channel to catch and direct the second tokens towards the second collection zone.

The retainer may comprise an elongate member insertable within the frame, the elongate member comprising a plurality of stoppers extending from the member for obstructing the pathways of the tokens.

The apparatus may comprise one or more further retainers arranged to temporarily retain one or more tokens at predefined locations along the pathways, the each further retainer movable between:

a first position where the retainer retains the tokens at the predefined locations along the pathways; and a second position where the retainer allows the tokens to move from the predefined locations under force of gravity.

In an embodiment, the game apparatus is connectable in endwise relationship to an adjacent game apparatus to define an enlarged game apparatus.

In an embodiment, the game apparatus comprises at least one joining device arranged to engage with a pair of adjacently disposed game apparatus so as to thereby connect the pair of adjacently disposed game apparatus together.

In an embodiment, the game apparatus comprises at least one lower joining device arranged to engage with feet of a pair of adjacently disposed game apparatus.

In an embodiment, the game apparatus comprises at least one upper joining device arranged to engage with adjacently disposed end walls of a pair of adjacently disposed game apparatus.

In an embodiment, the retainers of a pair of adjacently disposed game apparatus are connectable together so that the retaining members are movable together between the first position and the second position.

The first tokens may be visually distinct from the second tokens.

According to a second aspect of the invention, there is provided a game apparatus comprising:

a frame arranged to define a plurality of token receiving positions, each token receiving position configured to receive a token, the token receiving positions arranged in at least two rows located one above the other;

at least one retainer associated with each row of token receiving positions for controllably retaining the tokens in respective token receiving positions, the at least one retainer movable between:

(a) a first position wherein the at least one retainer retains one or more tokens in respective token receiving positions; and (b) a second position wherein the at least one retainer releases the one or more tokens from respective token receiving positions; and the frame further arranged to define multiple pathways along which tokens that have been released from respective token receiving positions can move under force of gravity when the at least one retainer is in the second position.

The plurality of token receiving positions may comprise first and second token receiving positions, the first token receiving positions located closer to a first side of the frame, and the second token receiving positions located closer to a second side of the frame opposite the first side.

The plurality of token receiving positions may be arranged in multiple columns, wherein the token receiving positions in each column defines one or more pathways along which tokens can move under force of gravity.

The at least one retainer may comprise a plurality of retainers each comprising an elongate member extendible lengthwise across the frame so as to define a plurality of rows of token receiving positions.

The apparatus may comprise at least one selectively movable control member in communication with the plurality of retainers, the control member movable between:

(a) a first location, which causes the retainers to move to the first position; and (b) a second location, which causes the retainers to move to the second position.

According to a further aspect of the invention, there is provided a game apparatus comprising:

a plurality of tokens including first tokens and second tokens;

a frame arranged to define multiple pathways along which the tokens are capable of moving in a first direction;

a retainer arranged to controllably retain the tokens relative to the pathways, the retainer movable between:

(a) a first position wherein the retainer retains the tokens relative to the pathways and prevents the tokens from moving in the first direction; and (b) a second position wherein the tokens are allowed to move in the first direction; and a separating mechanism arranged to direct the first tokens towards a first collection zone and to direct the second tokens towards a second collection zone, the separating mechanism comprising a first separating component associated with each first token and at least one second separating component associated with the frame, wherein when the retainer is in the second position, the first and second separating components cooperate to direct the first tokens away from the second collection zone and towards the first collection zone.

According to a further aspect of the invention, there is provided a game apparatus comprising:

a frame arranged to define a plurality of token receiving positions, each token receiving position configured to receive a token, the token receiving positions arranged in at least two rows located one above the other;

at least one retainer associated with each row of token receiving positions for controllably retaining the tokens in respective token receiving positions, the at least one retainer movable between:

(a) a first position wherein the at least one retainer retains one or more tokens in respective token receiving positions; and (b) a second position wherein the at least one retainer releases the one or more tokens from respective token receiving positions; and the frame further arranged to define multiple pathways along which tokens that have been released from respective token receiving positions can move in a first direction when the at least one retainer is in the second position.

According to a further aspect of the invention, there is provided a game apparatus comprising:

a plurality of tokens including first tokens and second tokens;

a frame arranged to define multiple pathways including: (a) first pathways along which the first tokens are capable of moving under force of gravity, each first pathway having a first guide portion configured to initially engage or receive the first tokens; and (b) second pathways along which the second tokens are capable of moving under force of gravity, each second pathway having a second guide portion configured to initially engage or receive the second tokens, wherein each first guide portion is located on a first side of the frame and each second guide portion is located on a second side of the frame opposite the first side, and wherein each first pathway is arranged relative to an associated second pathway such that tokens located along associated first and second pathways stack on top of each other; and a retainer for retaining the tokens at a position relative to the respective pathways;

wherein the tokens are capable of being released from the pathways by orienting the frame substantially upside down such that the tokens fall away from respective pathways via respective guide portions, wherein when the tokens are released from the pathways the first tokens are directed away from the second tokens by the first guide portions.

The second tokens may be directed away from the first tokens when the tokens are released from the pathways by orienting the frame substantially upside down.

Each first guide portion may incline away from the second side of the frame, and each second guide portion may incline away from the first side of the frame.

The first pathways may be completely separate from the second pathways.

Alternatively, the first pathways and second pathways may share a common portion.

According to a further aspect of the present invention, there is provided a token for use in at least one game, the token including at least one space or aperture configured such that airflow is still possible if the token is disposed in an airway of a person.

In an embodiment, the token includes a circumferential groove that defines a space for air to flow if the token is disposed in an airway of a person.

The token may include an aperture in a face of the token for air to flow if the token is disposed in an airway of a person.

According to a further aspect of the present invention, there is provided a game apparatus including a token for use in at least one game, the token including at least one space or aperture configured such that airflow is still possible if the token is disposed in an airway of a person.

According to a further aspect of the present invention, there is provided a game apparatus including a token assembly comprising a token for use in at least one game, the token including at least one space or aperture configured such that airflow is still possible if the token is disposed in an airway of a person, and a token holder arranged to receive the token and hold the token in a generally upright orientation.

BRIEF DESCRIPTION OF DRAWINGS

FIG. 3 is a perspective view of a retainer of the game apparatus shown in

FIG. 1.

DETAILED DESCRIPTION

Figure 1:
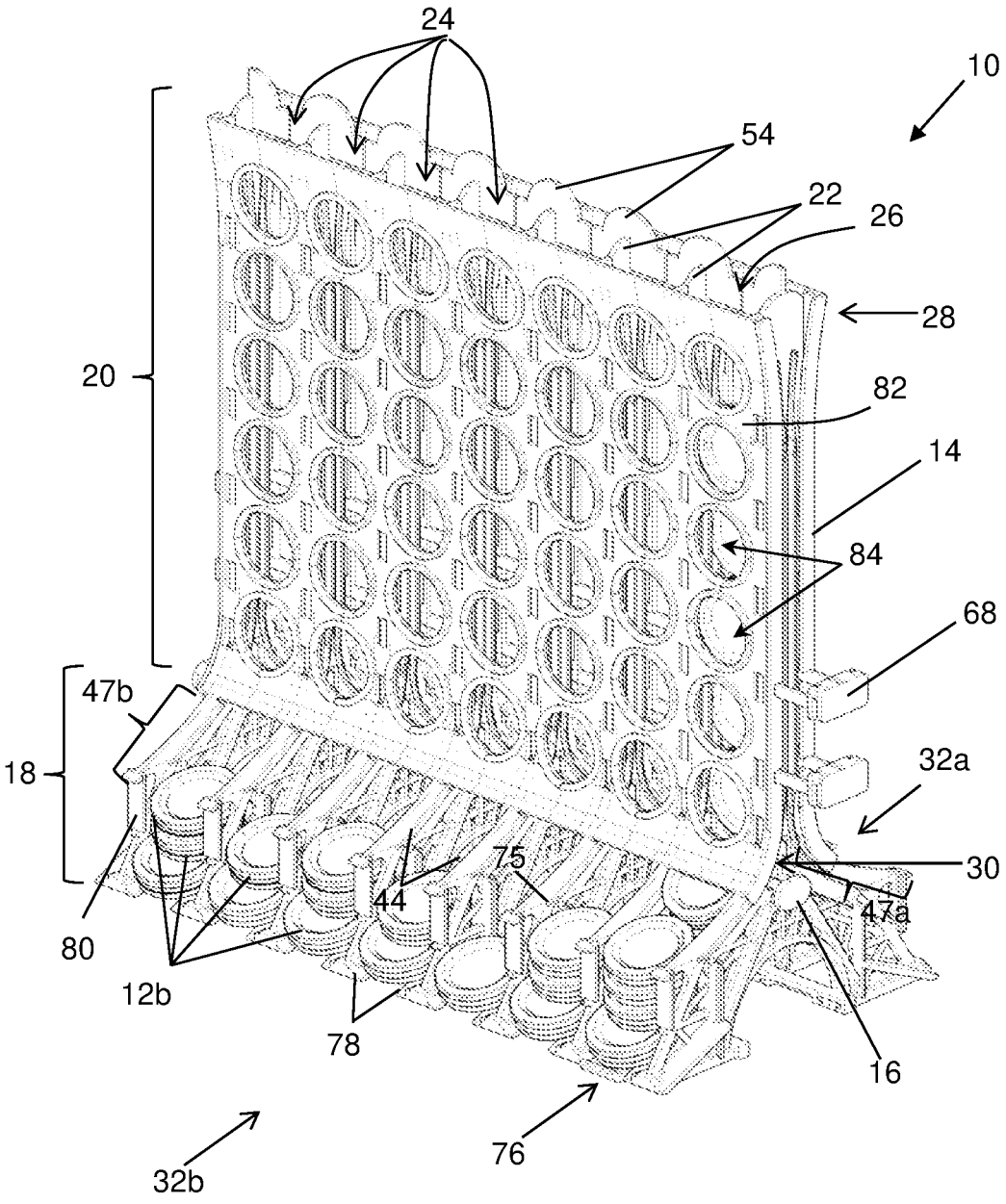
FIG. 1 is a perspective view of a game apparatus according to a first embodiment of the invention.

In general terms, aspects and embodiments of the present invention provide a game apparatus for a game that involves using a plurality of tokens including first tokens and second tokens that are typically visually distinct from each other. Examples of such games include "Go" and Connect Four®. The game apparatus comprises a frame defining multiple pathways, or alternatively multiple token receiving positions, in which a token can be placed according to the rules of the game. The frame is configured such that the tokens can be released from holding locations along the pathways, or from the token receiving positions, in a manner that causes the tokens to move under force of gravity.

According to an aspect of the invention, the frame is arranged such that when the tokens are released, the first tokens are directed to a first collection zone and the second tokens are directed to a second collection zone.

First Embodiment

Referring to FIGS. 1 to 5, a game apparatus 10 according to an embodiment of the invention is shown. The apparatus 10 comprises a plurality of tokens 12, a frame 14, a retainer 16 and a separating mechanism. The tokens 12 include a plurality of first tokens 12*a* and a plurality of second tokens 12*b* visually distinct from the first tokens 12*a*. For example, the first tokens 12*a* may have a different colour and/or pattern to the second tokens 12*b*. However, in this embodiment, the first 12*a* and second 12*b* tokens have the same shape and configuration. The game apparatus 10 in this example is particularly suitable for playing strategic games of alignment.

The frame 14 is arranged to define multiple pathways along which the tokens 12 are capable of moving under force of gravity. In this example, the frame 14 includes a base portion 18 and an upright structure 20 supported by the base portion 18. The upright structure 20 comprises a plurality of parallel and spaced-apart walls 22. The walls 22 divide the upright structure 20 into multiple substantially vertically-oriented channels 24 that are arranged side-by-side. The pathways in this example are provided in the channels 24, which will be described in more detail below. The tokens 12 can be inserted into the channels 24 through an opening 26 at a top end 28 of each channel 24. The tokens 12 will then drop under force of gravity along the pathways.

The retainer 16 is arranged to controllably retain the tokens 12 relative to the pathways. The retainer 16 is selectively movable between a first "holding" position wherein the retainer 16 retains the tokens 12 relative to the pathways, and a second "release" position wherein the tokens 12 are allowed to move under force of gravity. If the retainer 16 is in the release position, the tokens 12 will exit the channels 24 through a bottom end 30. If the retainer 16 is in the holding position, each channel 24 will receive and retain both first 12*a* and second 12*b* tokens in a stacked arrangement.

The separating mechanism is arranged to direct the first tokens 12*a* towards a first collection zone 32*a* and to direct the second tokens 12*b* towards a second collection zone 32*b* when the retainer 16 is in the release position. The separating mechanism comprises a first separating component 34 that forms part of the first and second tokens. The separating mechanism also comprises second separating components 36 associated with the frame 14 and arranged to direct the first tokens 12*a* towards the first collection zone 32*a*. The separating mechanism further comprises third separating components 38 associated with the frame 14 and arranged to direct the second tokens 12*b* to the second collection zone 32*b*. Each channel 24 is associated with a second separating component 36 and a third separating component 38.

For convenience, the separating mechanism will be described with reference to one channel 24 with the understanding that the same applies to other channels 24.

Figure 2:
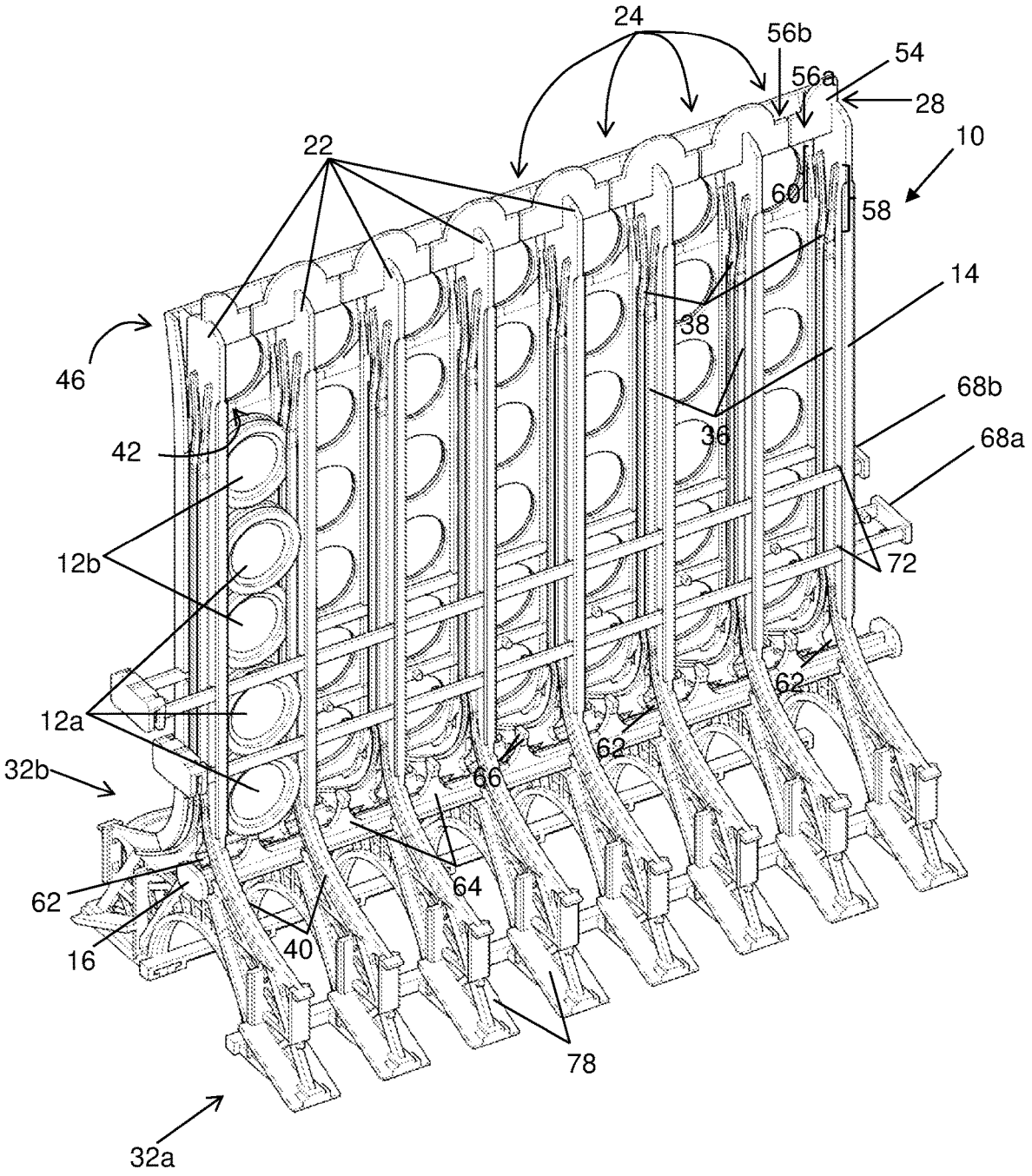
FIG. 2 is a perspective view of the game apparatus shown in FIG. 1, partially deconstructed.
Figure 4:
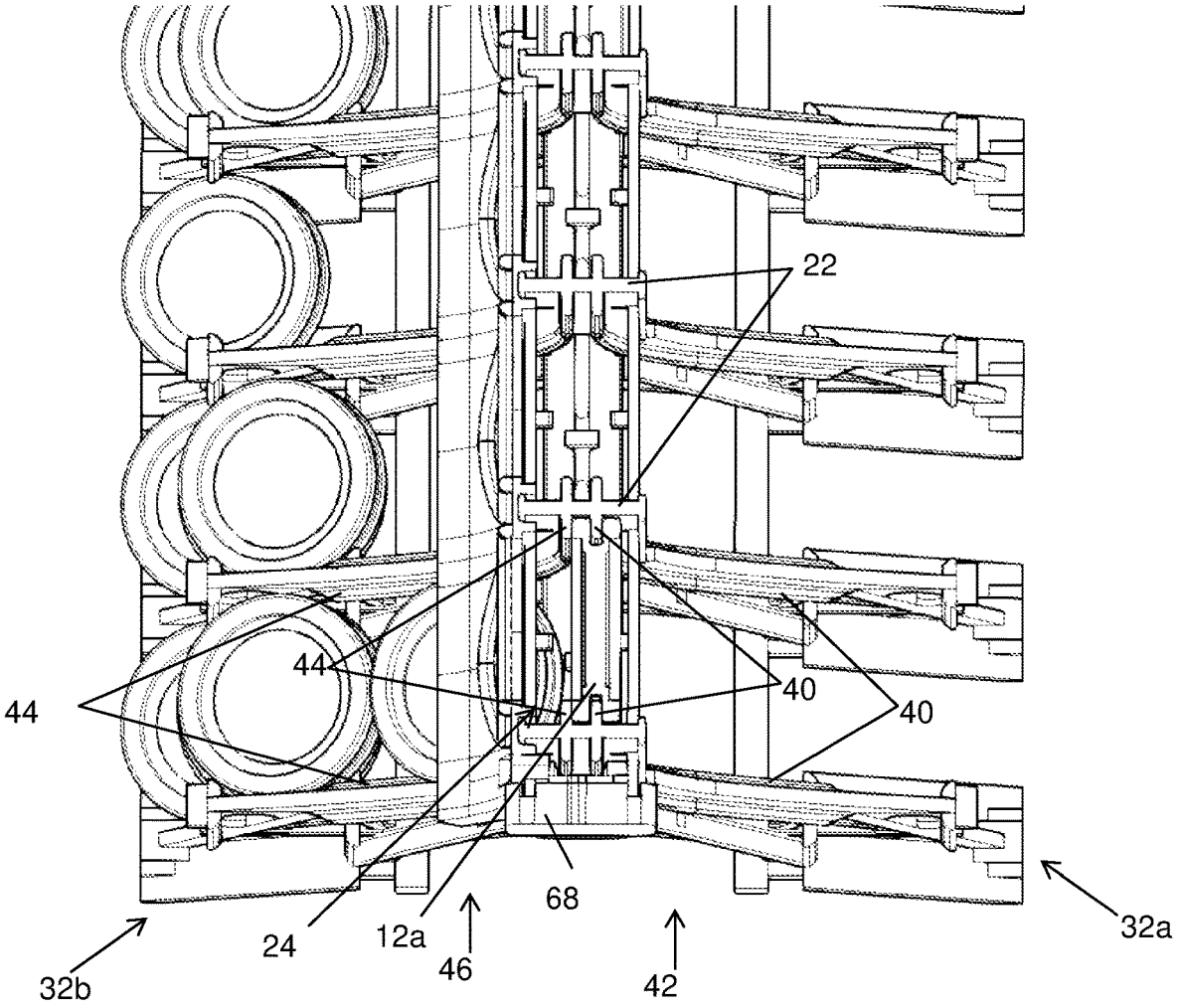
FIG. 4 is a cutaway top view of the game apparatus shown in FIG. 1.
Figure 5:
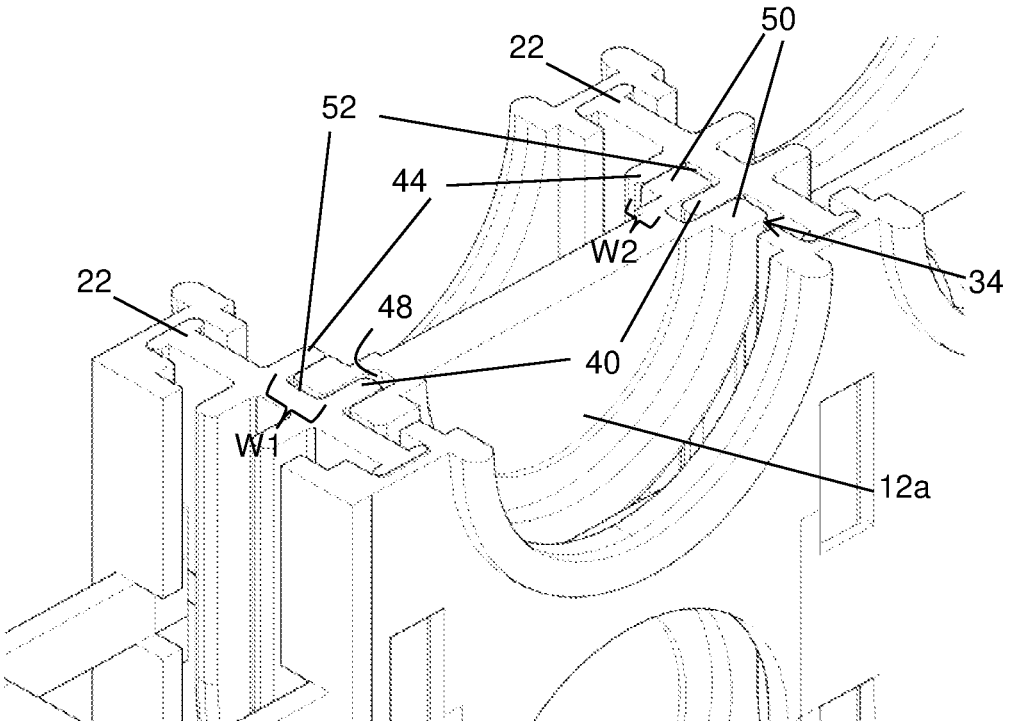
FIG. 5 is a partially cutaway perspective view of the game apparatus shown in FIG. 1.
Figure 6:
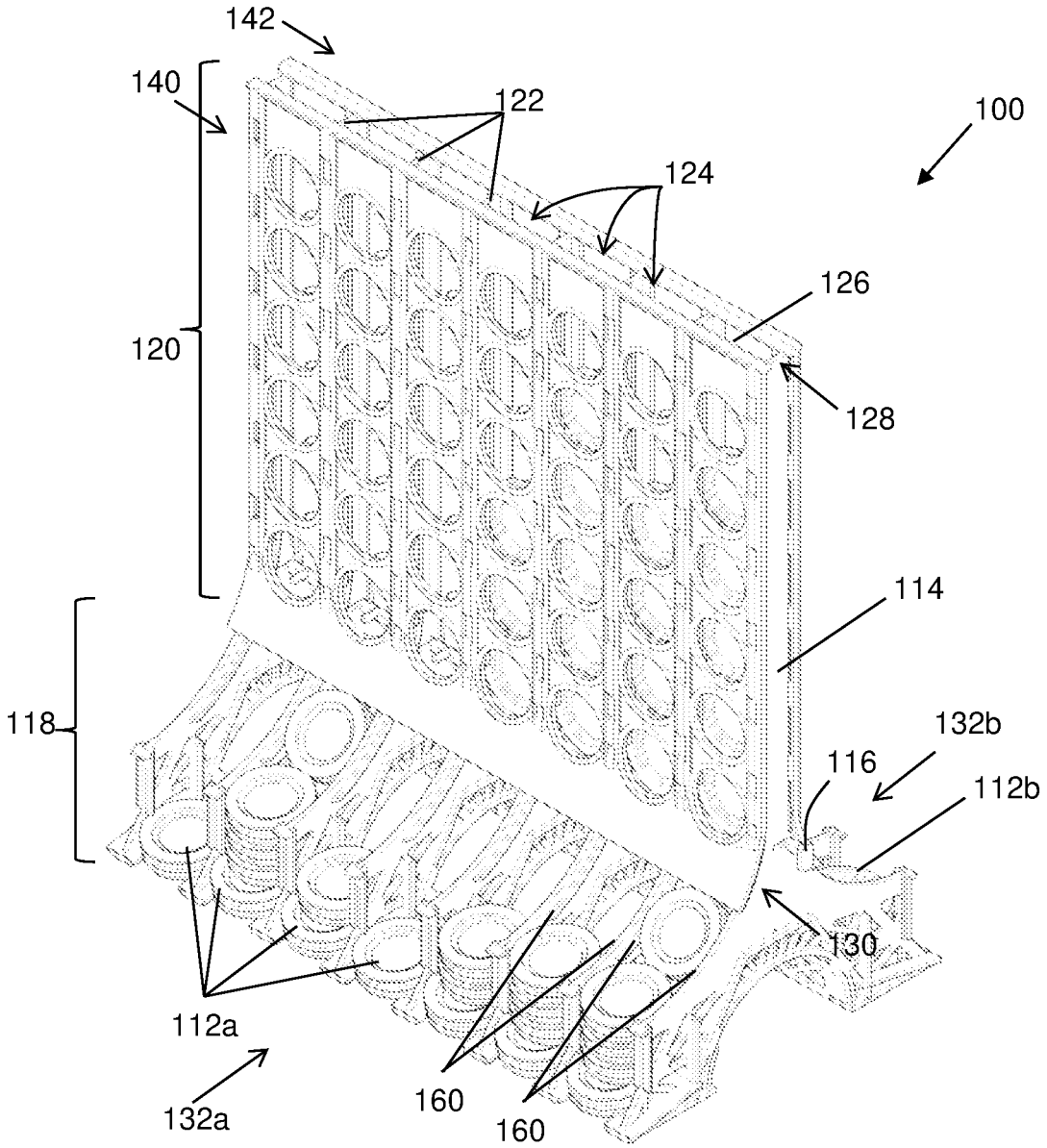
FIG. 6 is a perspective view of a game apparatus according to a second embodiment of the invention.

Referring to FIGS. 2, 4 and 5, the second separating component 36 comprises at least one guide, which in this example is implemented as a first pair of opposing rails 40. The first pair of rails 40 extends along the channel 24 and out of the bottom end 30 of the channel 24 to a first side 42 of the frame 14 where the first collection zone 32*a* is located.

The third separating component 36 comprises at least one guide implemented as a second pair of opposing rails 44 extending along the channel 24. The rails 44 extend out of the bottom end 30 to a second side 46 of the frame 14 opposite to the first side 42.

In this example, portions of the first rails 40 and second rails 44 within the channel 24 extend substantially parallel to each other along the channel 24. The first pair of rails 40 is closer to the first side 42 of the frame 14 and the second pair of rails 44 is closer to the second side 46 of the frame 14. Portions of the first rails 40 and second rails 44 that extend beyond the channel 24 (hereinafter referred to as "directing portions" 47*a* and 47*b*, respectively) curve away from each other towards a generally horizontal orientation.

FIG. 5 shows a cross-section of a token 12, in this example the first token 12*a*; however it will be appreciated that the second token 12*b* has the same shape and configuration. The token 12 has a disc-like shape. The first separating component 34 is embodied in the circumferential edge profile of the token 12. The edge profile of the token 12 comprises a circumferential groove 48 between two circumferential ridges 50.

During use, the first pair of rails 40 engages the first token 12*a* by receiving the first pair of rails in the circumferential groove 48 of the token 12. If the retainer 16 is in the release position, the token 12 will move along the rails 40 by force of gravity and be directed by the rails 40 to the first collection zone 32*a*.

It will be appreciated that another token 12, in this example a second token 12*b*, can similarly engage with the second pair of rails 44, in which case the second token 12*b* will be guided by the rails 44 to the second collection zone 32*b* when the retainer 16 is in the release position. Each pair of rails 40 and 44 thus defines a pathway along which the respective token 12*a* or 12*b* can move. Referring to FIGS. 4 and 5, the channel 24 comprises a common engagement portion engageable by both a first token 12*a* on the first pair of rails 40 and a second token 12*b* on the second pair of rails 44. In this example, the common engagement portion comprises a pair of opposing grooves 52, each groove in the pair defined by a space between a rail in the pair of rails 40 and an adjacent rail in the pair of rails 44. A width "W1" of each groove in the pair of grooves 52 is slightly larger than a width "W2" of a circumferential ridge 50 of a token 12.

When the first token 12*a* is engaged with the first pair of rails 40, a circumferential ridge 50 of the first token 12*a* will be received in the pair of grooves 52. Likewise, when a second token 12*b* is engaged with the second pair of rails 44, a circumferential ridge 50 of the second token 12*b* will also be received in the pair of grooves 52. This enables stacking of tokens 12 in a channel 24, even though the tokens 12 may be engaged with different pairs of rails 40 and 44 because a circumferential ridge 50 of each token 12 is received in the same pair of grooves 52.

A divider 54 is provided at the top end 28 of the channel 24. The divider 54 divides the opening 26 into two portions: a first portion 56*a* for guiding a first token 12*a* onto the first pair of rails 40, and a second portion 56*b* for guiding a second token 12*b* onto the second pair of rails 44. To accommodate the divider 54, an upper portion 58 of the first pair of rails 40 and an upper portion 60 of the second pair of rails 44 diverge away from each other, as shown in FIG. 1. The top end 28 of the channel 24 also widens to accommodate for the first 56*a* and second 56*b* portions of the opening 26. With reference to FIG. 2, an upper portion 58 of the first rails 40 converges so as to be positioned directly under the first portion 56*a* of the opening 26. Accordingly, placing the token 12*a* into the first portion 56*a* of the opening 26 will cause the token 12*a* to fall into engagement with the first pair of rails 40 and ultimately be directed to the first collection zone 32*a*. Similarly, the upper portion 60 of the second rails 44 converges so as to be positioned directly under the second portion 56*b* of the opening 26. Accordingly, placing the token 12*b* into the second portion 56*b* of the opening 26 will cause the token 12*b* to fall into engagement with the second pair of rails 40 and ultimately be directed to the second collection zone 32*b*.

It will be appreciated that during game play, the first tokens 12*a* will be assigned to a first player and the second tokens 12*b* will be assigned to a second player. The players will position themselves on respective sides 42 or 46 of the frame 14. In this example, the first player will place the first tokens 12*a* into respective first portions 56*a* of the channels 24, and thus the first tokens 12*a* will be returned to the first player at the first collection zone 32*a* via the first pairs of rails 40. Similarly, the second player will place the second tokens 12*b* into respective second portions 56*b* of the channels 24, and thus the second tokens 12*b* will be returned to the second player at the second collection zone 32*b* via the second pair of rails 44.

Referring to FIGS. 1 and 2, the retainer 16 in this example comprises an elongate body inserted into and slidingly movable with respect to the base portion 18 of the frame 14. The retainer 16 extends across the frame 14 and underneath the channels 24 through apertures 62 in each wall 22 of the frame 14. The retainer 16 comprises a plurality of stoppers 64 for stopping tokens 12 from moving out of respective channels 24. The stoppers 64 extend upwardly from the elongate body of the retainer 16 at regular intervals so as to align with corresponding channels 24. Each stopper 64 comprises lateral blocking portions 66 extending in opposite directions to each other, each blocking portion 66 arranged to abut a lowermost first token 12*a* or second token 12*b* in a respective channel 24, thus blocking the pathway of tokens.

The retainer 16 is controllably movable between the first holding position and second release position by moving the retainer 16 longitudinally. The retainer 16 is in the holding position when the stoppers 64 are located directly beneath respective channels 24 so as to obstruct the path of the tokens 12, as shown in FIG. 2. The retainer 16 is in the release position when the stoppers 64 are moved away from the path of the tokens 12, in this example within the apertures 62, so that the tokens 12 are not obstructed and can move to the respective collection zones 32*a* or 32*b*.

It will be understood that in order to minimise the likelihood that the retainer 16 will inadvertently move from the holding position to the release position, the retainer 16 and/or the base portion 18 may be arranged such that when the retainer 16 is disposed in the holding position, tokens 12 disposed during use on the retainer 16 urge the retainer towards the holding position. For example, the stoppers 64 may be located slightly off centre relative to a central longitudinal axis of a channel, such as 2 mm off centre for say a 32 mm diameter token, so that the tokens in the channel tend to urge the retainer 16 to move towards the holding position. The retainer may alternatively or in addition be held in the holding position using a snap-fit connection in order to prevent undesired movement of the retainer from the holding position to the release position.

Figure 3:
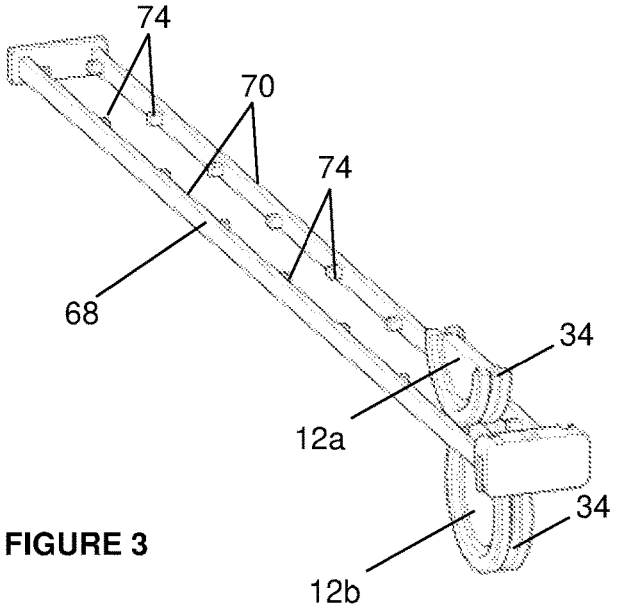

Referring to FIGS. 2 and 3, the apparatus 10 in this example also comprises one or more additional retainers 68 for selectively retaining a row of tokens 12 at a position above the base portion 18. The retainer 68 is also controllably movable between a first holding position and a second release position by moving the retainer 68 in a longitudinal direction.

Each additional retainer 68 comprises two parallel elongate members 70 inserted into the upright structure 20 of the frame 14. The retainer 68 extends across the channels 24 through apertures 72 in the walls 22. The retainer 68 comprises a plurality of spaced-apart stoppers 74 along each elongate member 70 for obstructing the path of the tokens 12. In this example, each stopper 74 projects inwardly from an elongate member 70 towards the other elongate member 70. This allows the stoppers 74 of the retainer 68 to obstruct the path of a token 12 when the retainer 68 is in the holding position, while allowing the token 12 to fall between the elongate members 70 when the retainer 68 is in the release position. Two elongate members 70 are provided because of the offset positioning of the first tokens 12*a* and second tokens 12*b* with respect to each other when stacked in the same channel 24. Thus, one of the elongate members 64 and its associated stoppers 74 serve to retain first tokens 12*a* in a row, while the other elongate member 70 and its associated stoppers 74 serve to retain second tokens 12*b* in the row.

FIG. 2 shows an example of two retainers 68 with a lower retainer shown in the holding position and an upper retainer shown in the release position.

It will be appreciated that such retainers 68 may be provided at any row of the upright structure 20.

An advantage of the additional retainer 68 is to allow for prolonged game play. For instance, if the retainer 68 is placed in the holding position with the retainer 16 in the holding position, and the retainer 16 subsequently moved to the release position, tokens 12 below the retainer 68 are released while any tokens 12 above the retainer 68 are retained. If the retainer 16 is then returned to the holding position and the retainer 68 moved to the release position, the tokens 12 previously held by the retainer 68 are caused to fall along the channels 24 until retained by the retainer 16, thereby allowing for continued game play.

In a similar way to the retainer 16, it will be understood that in order to minimise the likelihood that the additional retainer 68 will inadvertently move from the holding position to the release position, the retainer 68 and/or the frame 14 may be arranged such that when the additional retainer 68 is disposed in the holding position, tokens 12 disposed during use on the additional retainer 68 urge the additional retainer towards the holding position. For example, the stoppers 74 may be located slightly off centre relative to a central longitudinal axis of a channel, such as 2 mm off centre for say a 32 mm diameter token, so that the tokens in the channel tend to urge the additional retainer 68 to move towards the holding position.

The frame 14 is also arranged to stack the first tokens 12*a* in the first collection zone 32*a* and the second tokens 12*b* at the second collection zone 32*b*. This will be described with reference to FIG. 1 showing stacking of the second tokens 12*b*. In this example, the directing portion 47*b* of the second pair of rails 44 extending from a channel 24 transitions towards a generally horizontal orientation as it approaches an end 75 of the second pair of rails 44. For example, the directing portion 47*b* may ultimately transition to an angle of inclination from the horizontal of approximately 10°-30°, and preferably approximately 17°, while not becoming completely horizontal. This allows the second tokens 12*b* to continue to move under force of gravity along the second pair of rails 44 until the end 75 of the rails 44. Consequently, second tokens 12*b* proceeding from the channel 24 will also transition towards a generally horizontal orientation when moving along the directing portion 47*b*. The second token 12*b* will then fall from the end 75 of the second pair of rails 44 and land in a nearly horizontal orientation into a stacking region 76. A subsequent second token 12*b* proceeding from the channel 24 will then stack, in the generally horizontal orientation, on top of the second token 12*b* already in the stacking region 76.

Stoppers 80 may be provided at the end portion of the frame 14 to retain the second tokens 12*b* within the stacking region 76. A sloping bed, which in this example is in the form of a pair of sloping plates 78 (also shown in FIG. 2), is provided at the stacking region 76 onto which the second tokens 12*b* fall. The pair of sloping plates 78 slopes downwardly away from the upright structure 20, and has approximately the same angle of inclination as the directing portion 47*b*, e.g. approximately 17° from the horizontal. The sloping plates 78 allow the second tokens 12*b* stacked on the plates 78 to slide as close as possible to the stoppers 80. Furthermore, as shown in FIG. 1, the stoppers 80 in this example do not extend to a bottom of the frame 14, and therefore only serve to retain second tokens 12*b* stacked above the lowermost second token 12*b*. Thus, the lowermost second token 12*b* slides forwardly with respect to the tokens 12*b* above it, and partially emerges from the frame 14. This allows for ease of access to the relevant player.

The directing portion 47*a* of the first pair of rails 40 extending from the channel 24 is arranged in a similar manner as the direction portion 47*b* to direct and stack first tokens 12*a* proceeding from the channel 24 in the first collection zone 32*a*.

Plates 82 may be provided on sides 42 and 46 of the frame 14, each plate 82 comprising a plurality of viewing windows 84 to allow players to view the tokens 12 in the channels 24.

Second Embodiment

Referring to FIGS. 6 to 11, a game apparatus 100 according to another embodiment is shown. Like the apparatus 10, the apparatus 100 comprises a plurality of tokens 112, a frame 114 arranged to define multiple pathways along which the tokens 112 can move under force of gravity, and a retainer 116 controllably movable between a holding position and a release position for selectively retaining the tokens 112 relative to the pathways. Also, like the apparatus 10, the frame 114 includes a base portion 118 and a substantially upright structure 120 supported by the base portion 118, the structure 120 having substantially upright walls 122 defining a plurality of substantially vertically oriented channels 124 in which the pathways are provided. The apparatus 100 is also configured to receive the tokens 112 through an opening 126 at a top end 128 of the channels 124 and allow the tokens 112 to exit through a bottom end 130 of the channels 124 to either a first 132*a* or a second 132*b* collection zone. The apparatus 100 is suitable for playing the game CONNECT FOUR®.

However, unlike the apparatus 10, the plurality of tokens 112 comprises first tokens 112*a* and second tokens 112*b* that have a different shape and configuration to the first tokens 112*a*. The apparatus 100 also comprises a separating mechanism that is different to the separating mechanism of the apparatus 10. In particular, the separating mechanism comprises a first separating component 134 associated only with the first tokens 112*a*, second separating components associated with the frame 114, and third separating components 138 associated with the frame 114. The first and second separating components 134, 136 are mutually engageable and serve to direct the first tokens 112*a* toward the first collection zone 132*a* on a first side 140 of the frame 114. The third separating components 138 serve to direct the second tokens 112*b* to the second collection zone 132*b* on a second side 142 of the frame 114 opposite to the first side 140.

Figure 7:
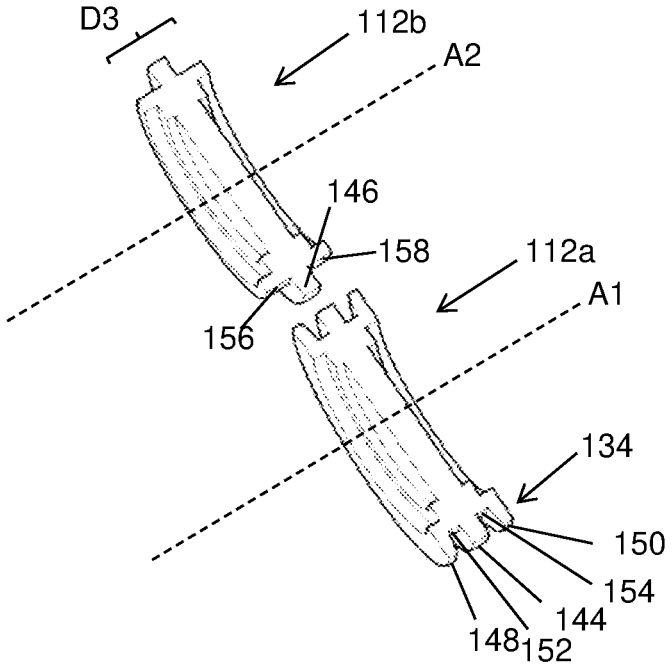
FIG. 7 is a partially cutaway perspective view of tokens of the game apparatus shown in FIG. 6.

Referring particularly to FIG. 7, a cross-sectional view of a first token 112*a* and a second token 112*b* is shown. Both the first 112*a* and the second 112*b* tokens are radially symmetrical about respective central axes "A1" and "A2". The first token 112*a* comprises a circumferential ridge 144 approximately midway along an overall depth "D3" of the first token 112*a* (hereinafter referred to as a "midway ridge 144"). Similarly, the second token 112*b* also comprises a circumferential ridge 146 approximately midway along an overall depth D3 of the second token 112*b*, wherein the second token 112*b* has the same overall depth D3 as the first token 112*a*.

The first separating component 134 on the first token 112*a* comprises first 148 and second 150 additional circumferential ridges. A first circumferential groove 152 is defined between the midway ridge 144 and the first additional ridge 148, and a second circumferential groove 154 is defined between the midway ridge 144 and the second circumferential ridge 150.

In contrast, the second token 112*b* does not include any additional circumferential ridges and instead comprises circumferential first 156 and second 158 shoulder portions symmetrically disposed on respective opposite sides of the circumferential ridge 146.

Figure 8:
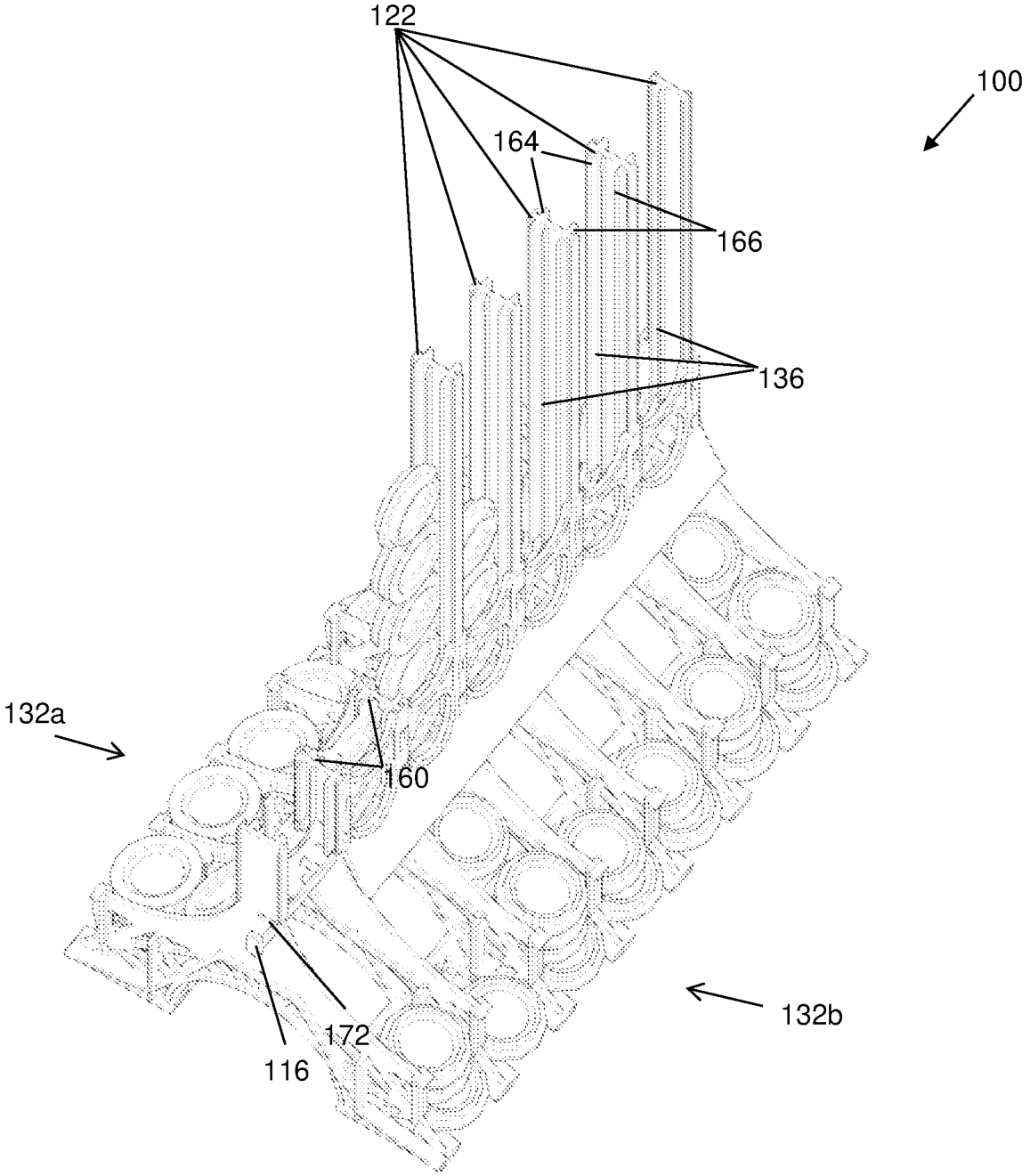
FIG. 8 is a partially cutaway perspective view of the game apparatus shown in FIG. 6, partially deconstructed.
Figure 10:
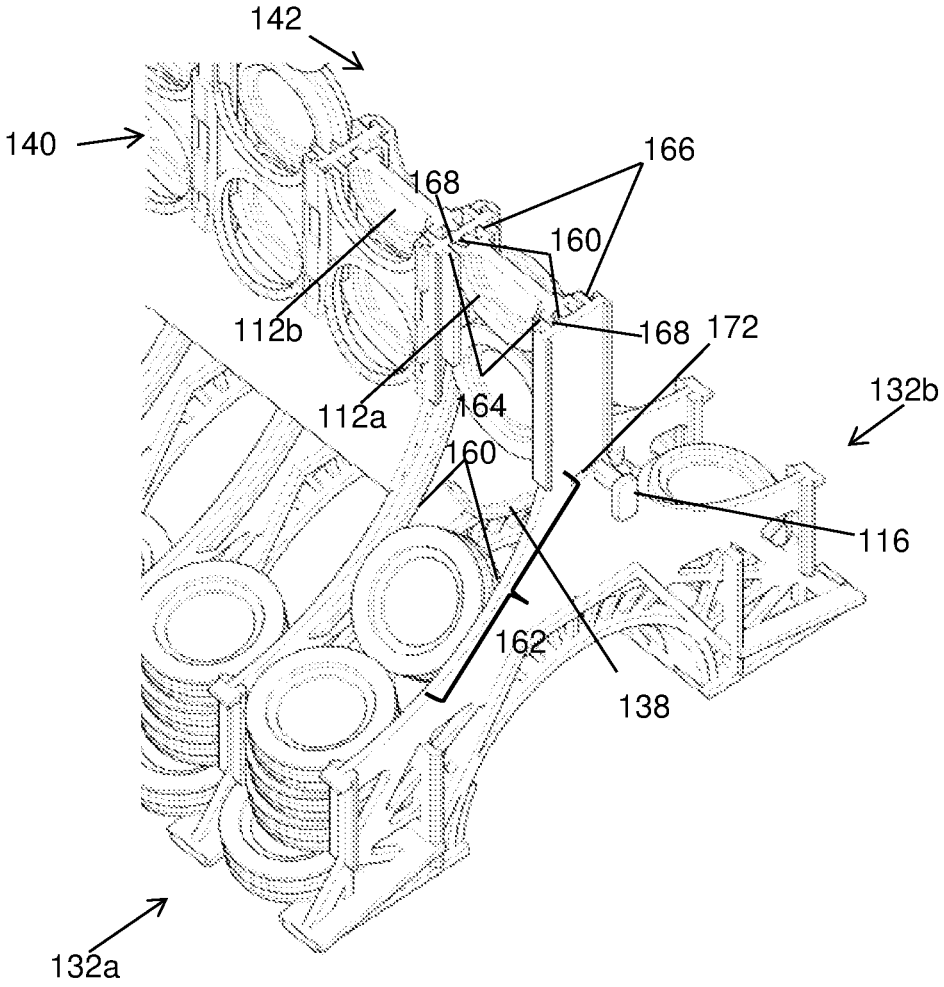
FIG. 10 is a partially cutaway perspective view of the game apparatus shown in FIG. 6.
Figure 11:
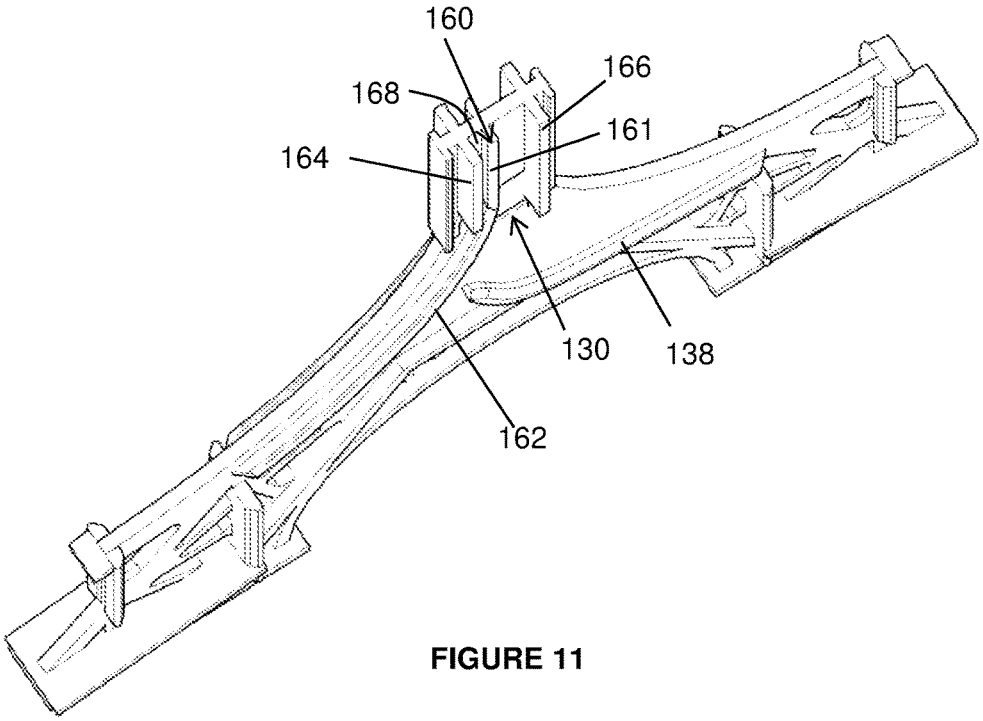
FIG. 11 is a partially cutaway perspective view of a portion of the game apparatus shown in FIG. 6.

Referring to FIGS. 8, 10 and 11, the separating mechanism will be described in more detail with reference to one channel 124, with the understanding that the same will apply to other channels 124. The channel 124 comprises the second separating component, which in this example comprises a first pair of opposed rails 160 substantially similar to the first pair of opposed rails 40 of the apparatus 10 shown in FIG. 1. In particular, as shown in FIG. 11, the first pair of rails 160 comprises a substantially vertical portion 161 extending along the channel 124 and a directing portion 162 extending from the bottom end 130 of the channel 124 to the first collection zone 132*a*. Like the directing portion 47*a* of the apparatus 10, the directing portion 162 of the pair of rails 160 is curved so as to gradually incline towards a generally horizontal orientation.

The channel 124 also comprises first 164 and second 166 pairs of opposing guide walls extending along the channel 124 substantially parallel to the first pair of rails 160. The first pair of rails 160 is disposed closer to the first pair of guide walls 164 than the second pair of guide walls 166. A pair of opposed grooves 168 is defined between the first pair of rails 160 and the first pair of guide walls 164.

Both a first token 112*a* and a second token 112*b* may be received in the channel 124 between the first 164 and second 166 pairs of guide walls; however, only the first token 112*a* engages with the first pair of rails 160 since the first token 112*a*, but not the second token 112*b*, includes first and second circumferential ridges 148, 150.

With reference to FIGS. 7 and 10, when a first token 112*a* is inserted into a channel 124, the first pair of rails 160 engages the first token 112*a* by virtue of a circumferential ridge 148, 150 being received in the groove 168, and by virtue of the rails 160 being received in the first circumferential groove 152. In this way, the first token 112*a* remains engaged with the first pair of rails 160 until it reaches the first collection zone 132*a* and a pathway of movement of the first token 112*a* along the channel 124 is thereby defined by the first pair of rails 160.

When a second token 112*b* is received in a channel 124, the second token 112*b* is located between the pairs of guide walls 164, 166 such that the circumferential ridge 146 of the second token 112*b* is disposed between the first pair of rails 160 and the second pair of guide walls 166, as shown in FIG. 10.

Since the second token 112*b* does not have an additional circumferential ridge 148, 150, the second token 112*b* does not engage with the first pair of rails 160, is not guided by the first pair of rails 160 to the first collection zone 132*a*, and instead will drop out of the bottom end 130 of the channel 124 onto the third separating component 138.

However, it will be appreciated that the movement pathway of the second token 112*b* is the same as the movement pathway of the first token 112*a* while in the channel 124, and accordingly the first 112*a* and second 112*b* tokens disposed in the same channel 24 will stack on top of each other.

In this example, the third separating component comprises a second pair of opposing rails 138 disposed below the bottom end 130 of the channel 124, although only one such rail 138 can be seen in FIGS. 10 and 11. Each rail 138 is curved and disposed so as to catch the second tokens 112*b* as they drop from the bottom end 140 of the channel 124 and direct the second tokens 112*b* towards the second collection zone 132*b*. In particular, the second pair of rails 138 catch the circumferential ridge 146 of the second token 112*b* and urge the second tokens 112*b* towards a substantially horizontal orientation before reaching the second collection zone 132*b*.

The first and second tokens 112*a*, 112*b* are stacked at the first and second collection zones 132*a*, 132*b* in substantially the same manner as described above in relation to the apparatus 10.

It will be appreciated that unlike the apparatus 10, it is not necessary with the apparatus 100 to locate the first 112*a* and second 112*b* tokens in dedicated portions of the opening 126 (for example using dividers 52) so to ensure that the tokens engage with correct rails in the channels 124. This is because the configuration of the tokens 112 themselves determines whether the tokens 112 will be directed to the first 132*a* or the second 132*b* collection zone.

Figure 9:
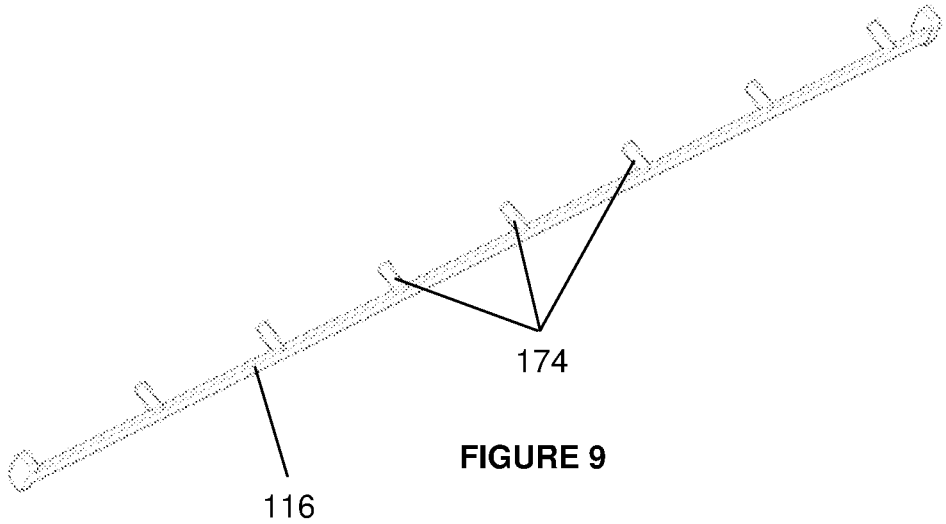
FIG. 9 is a perspective view of a retainer of the game apparatus shown in FIG. 6.

With particular reference to FIG. 9, the retainer 116 is shown. The retainer 116 has the same purpose as the retainer 16 of the apparatus 10. Like the retainer 16, the retainer 116 also comprises an elongate body inserted in the base portion 118 of the frame 114 through apertures 172 in the walls 122 so that the retainer 116 extends generally underneath the channels 124. In a variation from the retainer 16, the retainer 116 comprises stoppers 174 extending laterally from the elongate body of the retainer at regular intervals in order to align with corresponding channels 124 when the retainer 116 is disposed in the holding position. The elongate body of the retainer 116 is offset from the pathway of the tokens 112 to allow the tokens 112 to move past the elongate body when the retainer 116 is in the release position. However, when the retainer 116 is in the holding position, the stoppers 174 block the pathway of tokens 112 in a respective channel 124.

Third Embodiment

Figure 12:
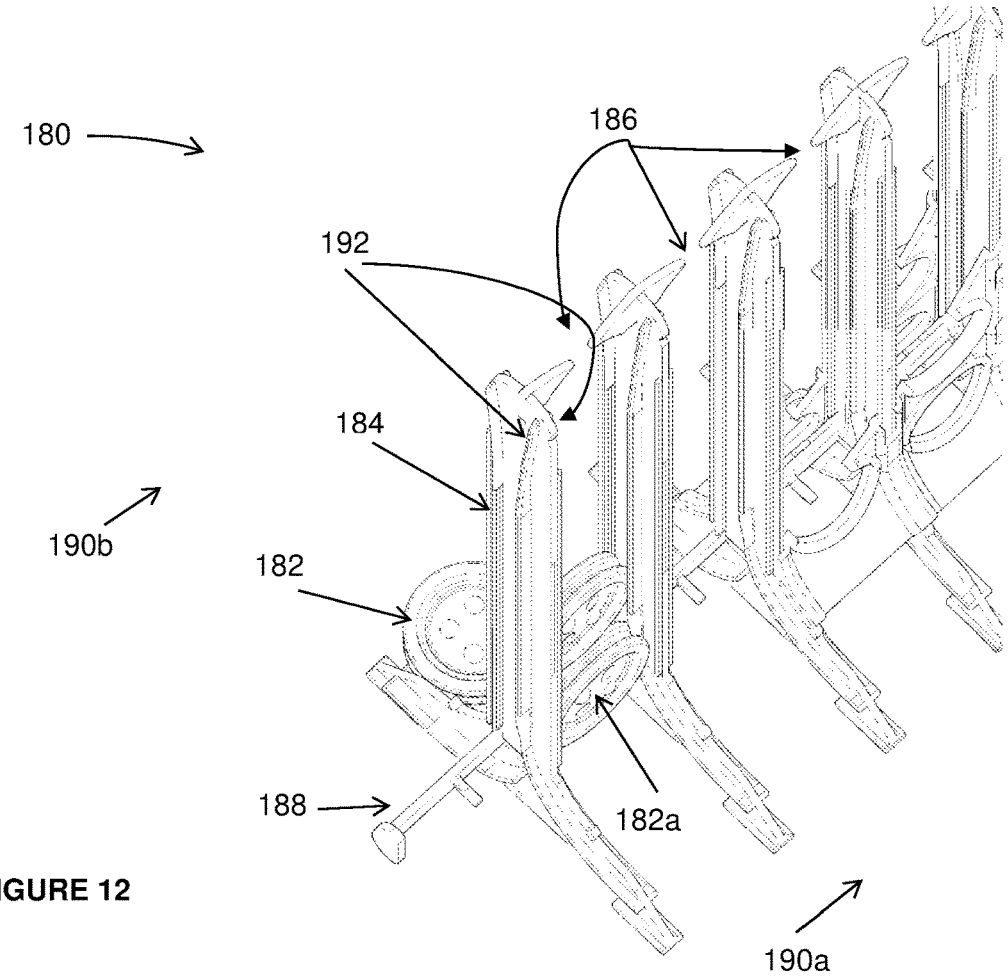
FIG. 12 is a perspective view of a portion of a game apparatus according to a further embodiment of the invention.
Figure 13:
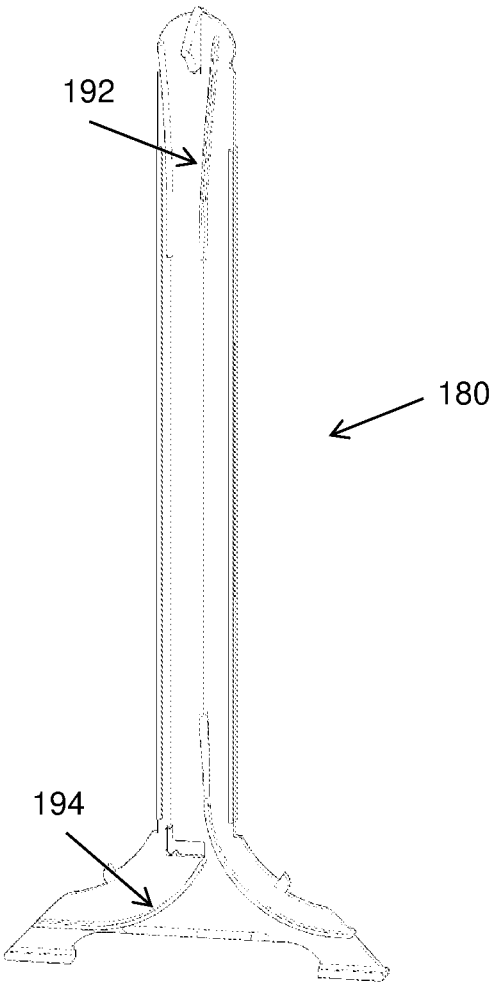
FIG. 13 is an elevation view of a channel component of the game apparatus shown in FIG. 12.

Referring to FIGS. 12 and 13, a game apparatus 180 according to another embodiment is shown. The apparatus 180 comprises a plurality of tokens 182 comprising first tokens 182*a* and second tokens 182*b* that have the same shape and configuration but are visually distinct from each other, for example because they have a different colour; a frame 184 arranged to define multiple channels 186 along which the tokens 182 can move under force of gravity; and a retainer 188 controllably movable between a holding position and a release position so as to selectively retain the tokens 182 relative to the pathways.

The apparatus 180 is similar to the embodiment shown in FIGS. 1 to 5 in that the first and second tokens 182*a*, 182*b* have the same shape and configuration and are caused to be directed towards a first or second collection zone 190*a*, 190*b* in part because the first and second tokens 182*a*, 182*b* are offset relative to each other in the channel 186 towards the first collection zone or the second collection zone 190*a*, 190*b*. However, unlike the embodiment shown in FIGS. 1 to 5 that includes a first pair of rails 40 for the first tokens 12*a* and a second pair of rails 44 for the second tokens 12*b*, the apparatus 180 includes one pair of rails 192 that, because of the offset location of the first tokens 182*a*, engages only with the first tokens 182*a*. The second tokens 182*b*, because of the offset location of the second tokens 182*b*, do not engage with the pair of rails 192 and instead fall onto a separating component 194 in a similar way to the embodiment shown in FIGS. 6 to 11.

Fourth Embodiment

Figure 14:
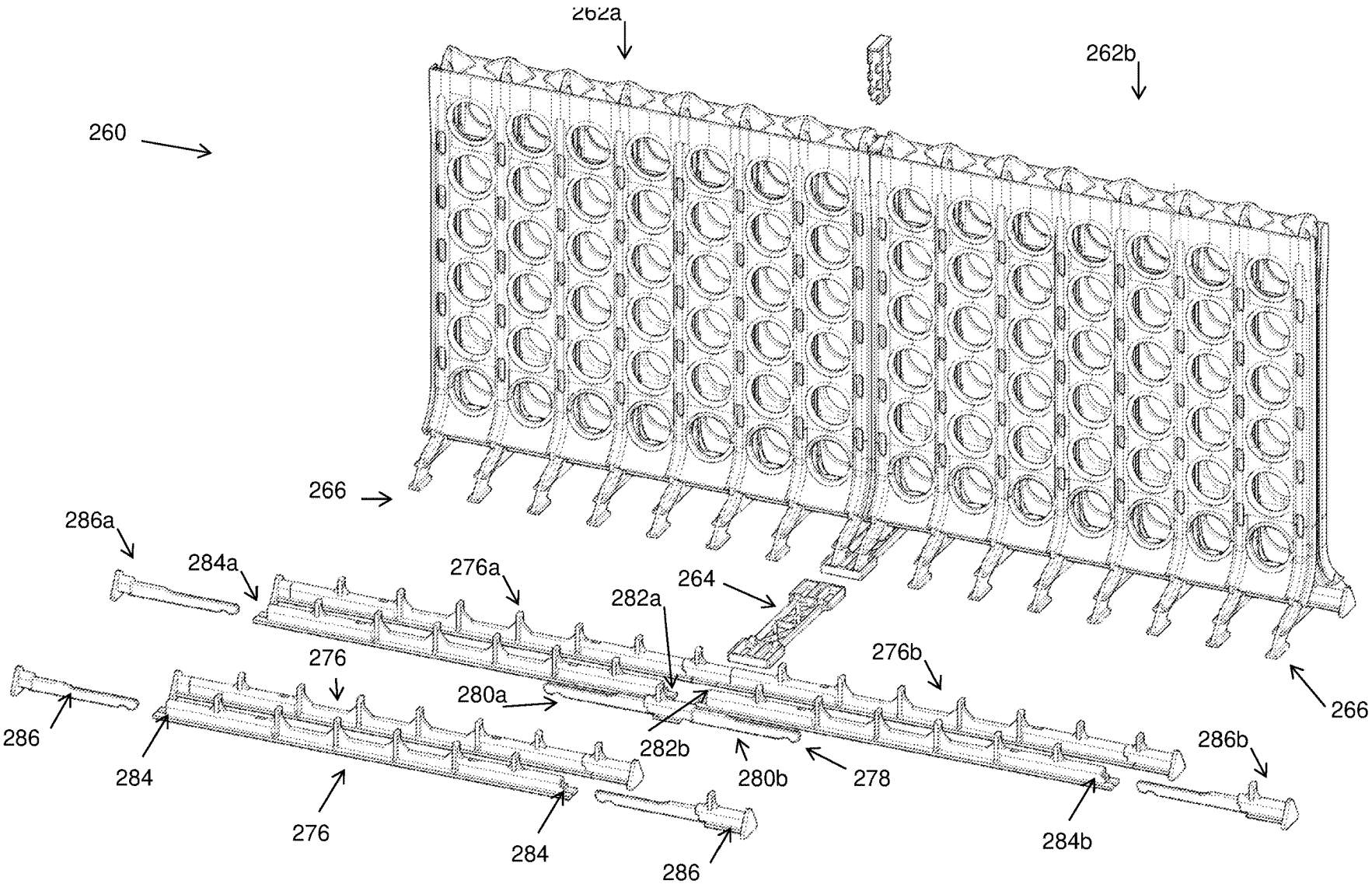
FIG. 14 is a perspective view of a game apparatus according to a further embodiment of the invention.
Figure 15:
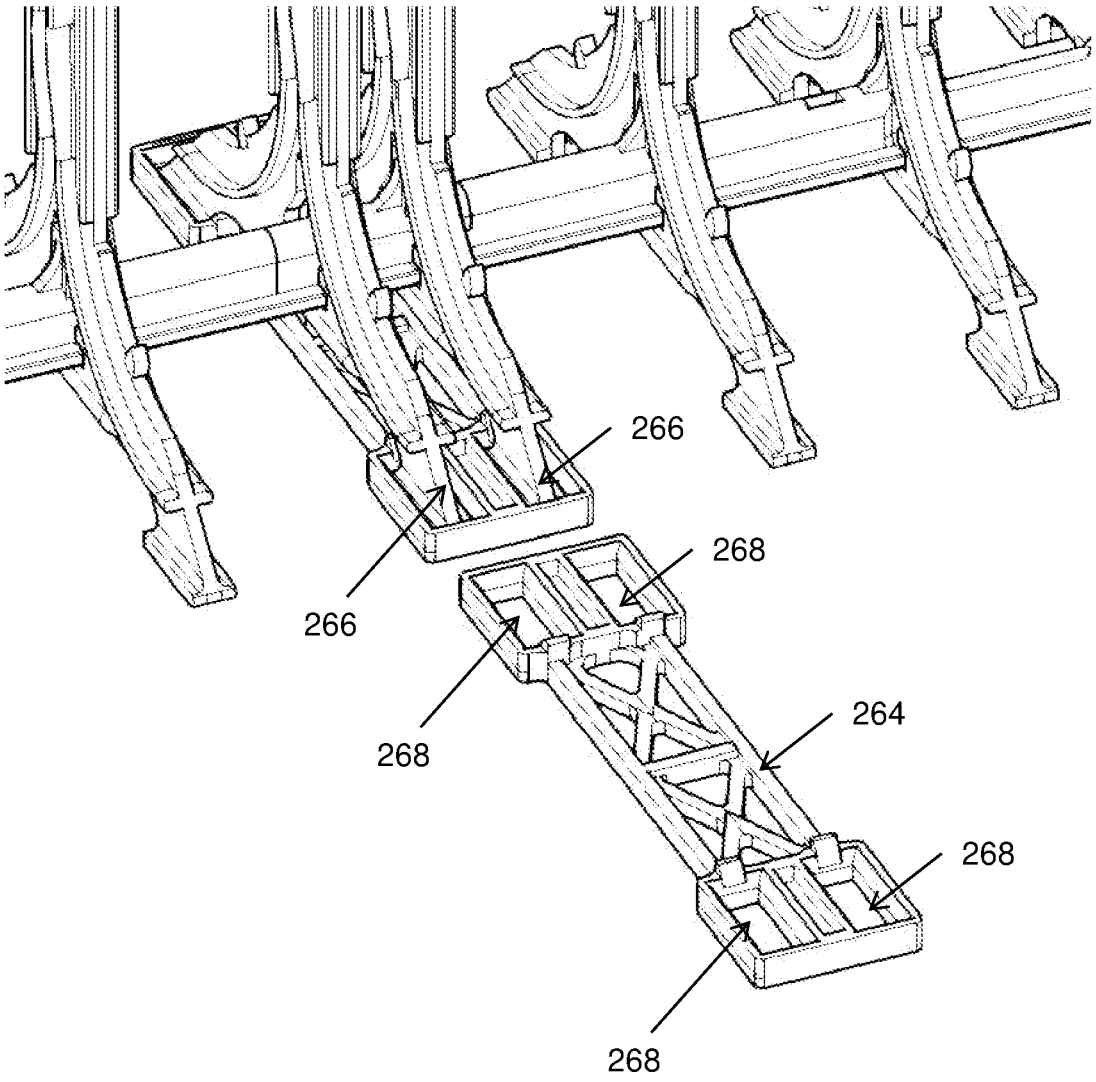
FIG. 15 is a perspective view of a lower joining device of the game apparatus shown in FIG. 14.
Figure 16:
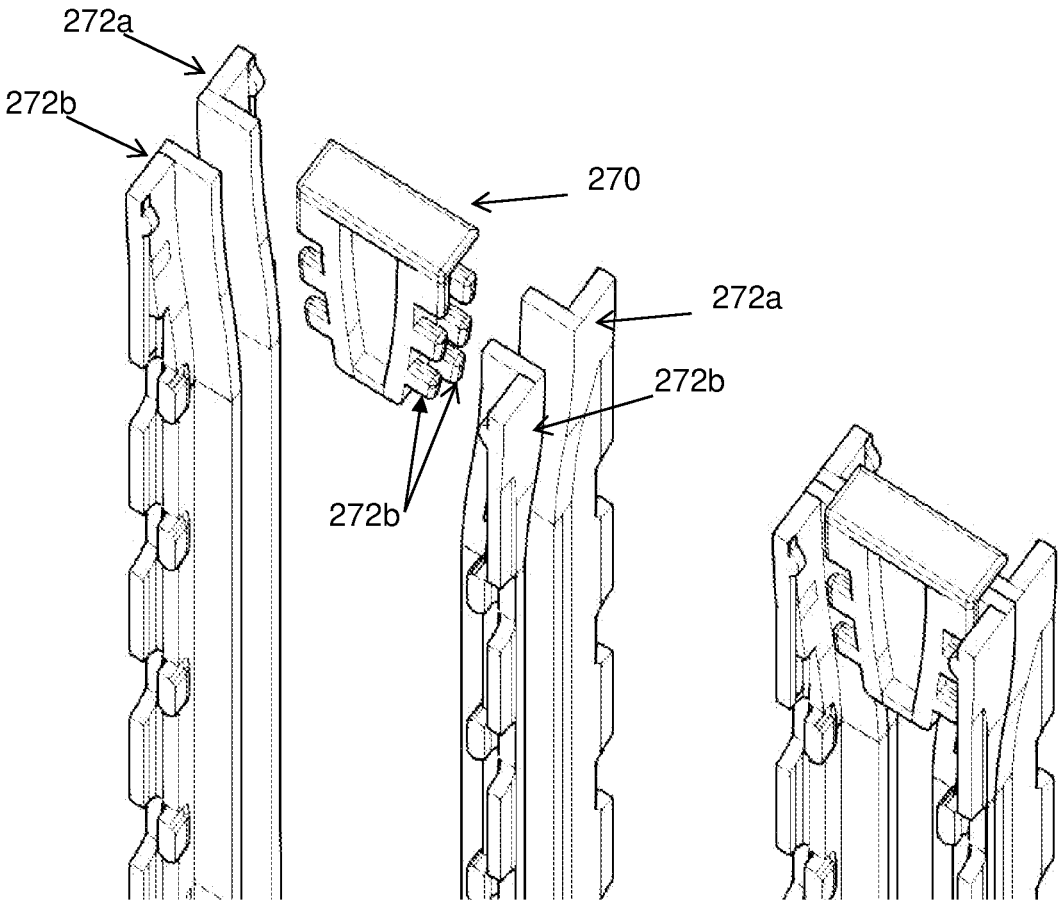
FIG. 16 is a perspective view of an upper joining device of the game apparatus shown in FIG. 14.

Referring to FIGS. 14 to 16, an expanded game apparatus 260 according to another embodiment is shown. The expanded game apparatus 260 includes multiple individual game apparatus 262*a*, 262*b* connected together to define an enlarged game apparatus. Each game apparatus 262*a*, 262*b* may correspond substantially to any of the game apparatus embodiments shown and described in the present specification.

The frames of individual game apparatus 262*a*, 262*b* may be connected together in any suitable way, for example using lower joining devices 264 as shown in FIG. 15 that engage with feet 266 of adjacent game apparatus 262*b* by receiving the feet 266 in respective correspondingly shaped recesses 268 of a lower joining device 264. The frames of the individual game apparatus 262*a*, 262*b* may also be connected together using upper joining devices 270 as shown in FIG. 16 that engage with adjacently disposed end walls 272*a*, 272*b* of an adjacent pair of aligned individual game apparatus 262*a*, 262*b*. In this example the upper joining device 270 connects the adjacently disposed end walls 272*a*, 272*b* together by clamping the end walls 272*a*, 272*b* between spaced plates 274 of the upper joining device.

However, it will be understood that any suitable arrangement or combination for holding adjacently disposed game apparatus together in endwise relationship is envisaged.

As shown more particularly in FIG. 14, respective retaining members 276*a*, 276*b* of the adjacently disposed individual game apparatus 262*a*, 262*b* may also be connected together so that the retaining members 276*a*, 276*b* are movable together between the holding position and the released position. In this way, the tokens can be released from both game apparatus 262*a*, 262*b* at the same time.

In the present example, the retaining members 276*a*, 276*b* are connected together using a joining device 278 provided with 2 oppositely extending projections 280*a*, 280*b* that respectively engage with hollow end portions 282*a*, 282*b* of the retaining members 276*a*, 276*b*. Free ends 284*a*, 284*b* of the retaining members 276*a*, 276*b* receive end caps 286*a*, 286*b*.

It will also be understood that when a game apparatus 262*a* is not connected to an adjacent game apparatus 262*b*, the end caps 286 are engaged with the 2 free ends of the retaining member 276.

It will also be understood that any number of individual game apparatus 262 may be connected together in this way to provide an extended game apparatus 260 of any desired size.

It will be appreciated that the expanded game apparatus may be more suitable for team game play, for example with 2 players on each side of the extended game apparatus 260.

Fifth Embodiment

Figure 17:
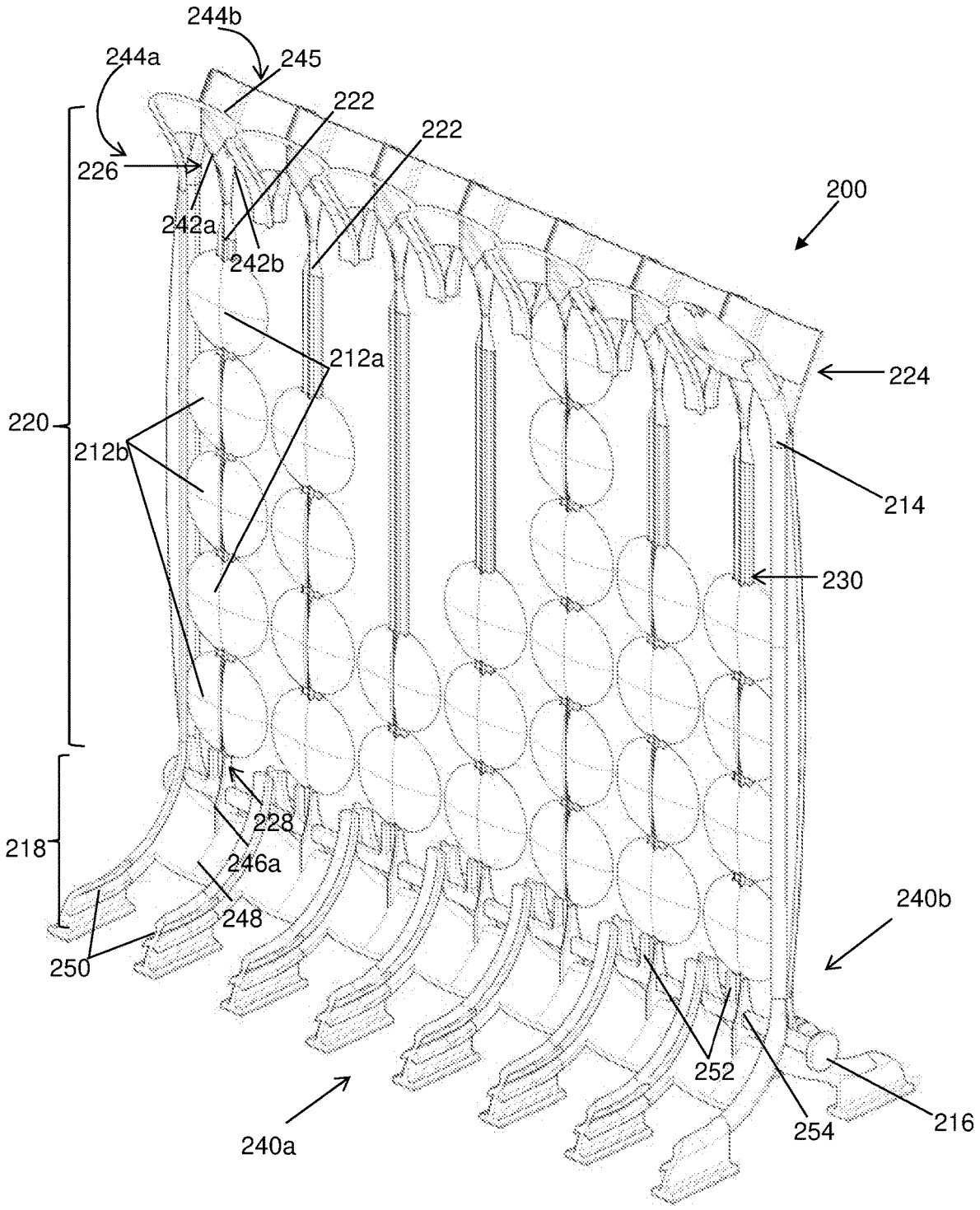
FIG. 17 is a perspective view of a game apparatus according to a further embodiment of the invention.
Figure 18:
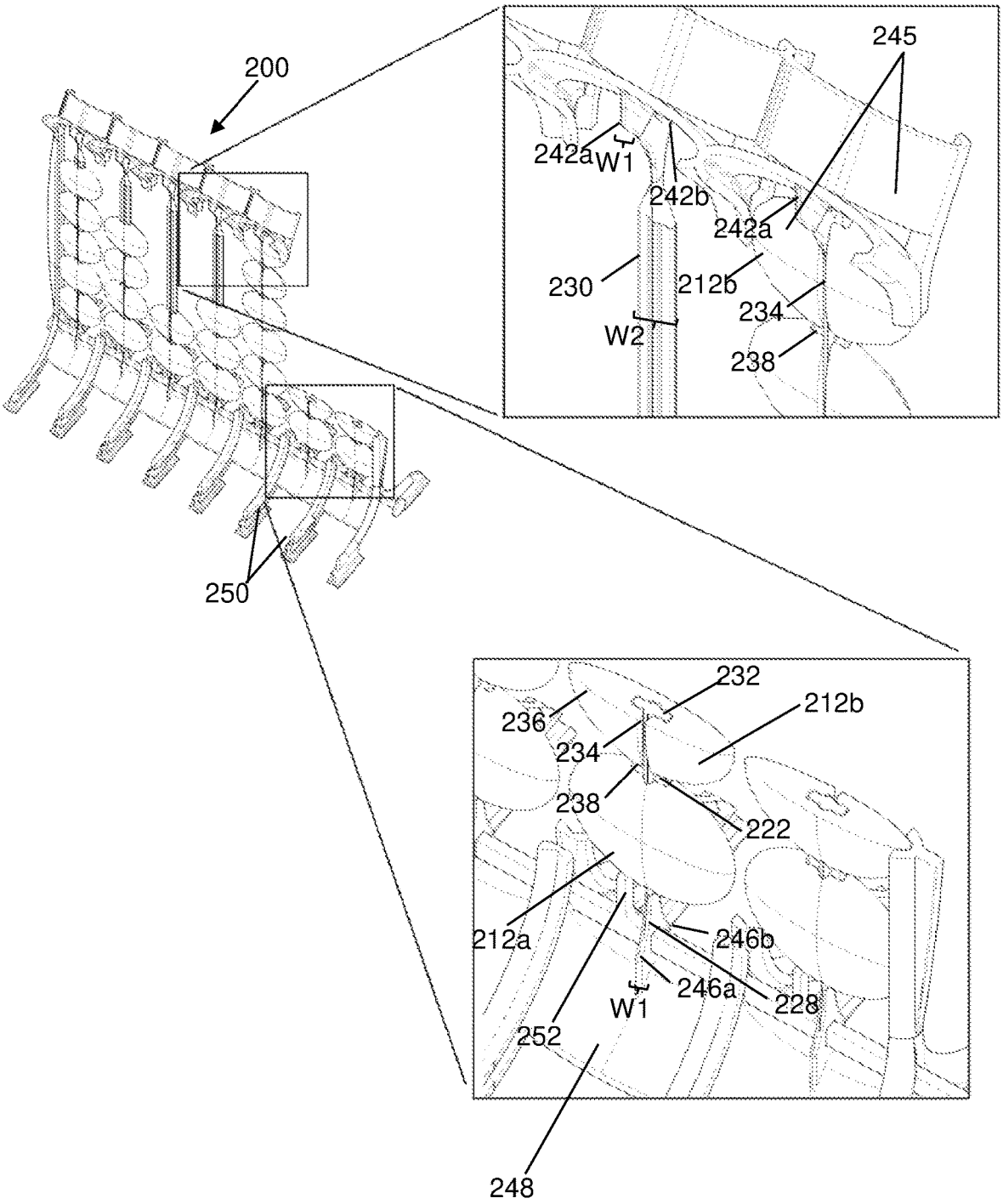
FIG. 18 shows two magnified views of portions of the game apparatus shown in FIG. 17.

Referring to FIGS. 17 and 18, a game apparatus 200 according to another embodiment is shown. Like the game apparatuses 10 and 100, the apparatus 200 generally comprises a plurality of tokens 212 comprising first tokens 212*a* and second tokens 212*b* that have the same configuration but are visually distinct from the first tokens 212*a*, a frame 214 arranged to define multiple pathways along which the tokens 212 can move under force of gravity, and a retainer 216 controllably movable between a holding position and a release position so as to selectively retain the tokens 212 relative to the pathways. The frame 214 comprises a base portion 218 and a substantially upright structure 220 supported by the base portion 218. The apparatus 200 is particularly suitable for playing the game Connect Four®.

However, unlike the apparatuses 10 and 100, the frame 214 of the apparatus 200 does not define a plurality of substantially vertically oriented channels in which the pathways are located. Instead, the pathways along which the tokens 212 move are each defined by a rail 222 engageable with the first 212*a* and second 212*b* tokens. The rail 222 is supported in a substantially vertical orientation between a top end 224 of the frame 214 and the base portion 218. Each rail 222 has an upper "engaging" end portion 226, a lower "disengaging" end portion 228, and an intermediate portion 230 between the upper and lower end portions 226, 228.

The apparatus 200 also comprises a separating mechanism that is different to those of the apparatuses 10 and 100. The separating mechanism of the apparatus 200 comprises a first separating component associated with each of the first and second tokens 212*a*, 212*b*. In particular, with reference to in FIG. 18, the first separating component comprises a diametrically extending channel 232. The channel 232 is substantially linear, is contiguous with a slot 234 in a face 236 of the second token 212*b*, and has openings 238 at opposite ends of the channel 232.

The separating mechanism also comprises second separating components associated with the frame 214. Each second separating component comprises a disengaging end portion 228 of a rail 222, which facilitates disengagement of a token 212 from the rail 222.

The engaging end portion 226 and the disengaging end portion 228 of a rail 222 both have the same width "W1", which is smaller than a width "W2" of the intermediate portion 230. In this example, the engaging end portion 226 has a "Y" shape and comprises a first branch 242*a* on a first side 244*a* of the frame 214, and a second branch 242*b* on a second side 244*b* of the frame 214 opposite the first side 244*a*. The first 242*a* and second 242*b* branches converge before reaching the intermediate portion 230.

A width of the slot 234 of the token 212, in this example the second token 212*b*, is slightly larger than the width W1 of the engaging end portion 226. This allows the second branch 242*b* of the engaging end portion 226 to be received in the slot 234 of the second token 212*b*, thus initially engaging the second token 212*b* on the rail 222. It will be appreciated that a first token 212*a* can be similarly engaged initially onto the first branch 242*a*.

Guiding sleeves 245 are provided at the top end 224 of the frame 214 to guide placement of a token 212 onto a first or second branch 242*a* or 212*b*. In this example, the guiding sleeve 245 has a width slightly larger than the token 212. In the example shown in FIG. 18, a first branch 242*a* is substantially centrally located within the guiding sleeve 245 so that when a first token 212*a* is inserted through the guiding sleeve 245, the first branch 242*a* will engage with the slot 234 of the first token 212*a* if the first token 212*a* has been inserted correctly with the slot 234 facing toward the frame portion 244*a* and typically away from the relevant player.

During game play, a player places a token 212 on the rail 222 by positioning the token 212 so that the slot 234 faces towards the relevant frame side 244*a* or 244*b* and typically away from the player, and inserting the token 212 edge first through the guiding sleeve 245.

Further, a width of the channel 232 is slightly larger than the width W2 of the intermediate portion 230. Therefore, the width of the slot 234 is also smaller than the width W2 of the intermediate portion 230. Accordingly, as a token 212 moves from the upper engaging end portion 226 down the rail 222, it reaches the intermediate portion 230 and is able to slide along the intermediate portion 230. However, since the width of the slot 234 is smaller than the width W2, the first token 212*a* cannot be removed from the rail 222 while engaged on the intermediate portion 230.

As the first token 212*a* continues moving down the rail 222, the first token 212*a* will eventually reach the lower disengaging end portion 228 of the rail 222. The disengaging end portion 228 broadens out to a first shoulder portion 246*a* on the first side 244*a* of the frame, and a second shoulder portion 246*b* on the second side 244*b* of the frame.

Since each token 212 can only be released to the same side in which it was initially engaged, the token 212 will move onto the shoulder portion 246. As the token 212 moves down the shoulder portion 246 by force of gravity, the shoulder portion 246 will simultaneously push the token 212 towards the relevant first or second side 244*a*, 244*b* and disengage from the slot 234. At the same time, the token 212 will also be received by a sloped cradle 248, which directs the token 212 towards a pair of opposed curved gutters 250. The pair of gutters 250 engages an edge of the token 212, rotates the token 212 towards a generally horizontal orientation, and guides the token 212 to the relevant first or second collection zone 240*a*, 240*b*. It will be appreciated that unlike the collection zones described above in relation to the apparatuses 10 and 100, which are defined by physical boundaries, the first and second collection zones 240*a*, 240*b* in this example of the apparatus 200 are not defined by physical boundaries. Instead, the first and second collection zones 240*a*, 240*b* each comprise an area on opposite sides of the frame 214 in proximity to a bottom of the frame 214.

The retainer 216 has substantially the same purpose as the retainers 16 and 116 described above in relation to other embodiments. The retainer 216 comprises an elongate body and a plurality of stoppers 252 extending upwardly from the elongate body at regular intervals. The retainer 216 extends through apertures 254 in the lower disengaging end portions 228 of the rails 222. When the retainer 216 is in the holding position, the stoppers 252 block respective pathways of the tokens 212 onto respective shoulder portions 246*a* or 246*b*. When the retainer 216 is moved in a longitudinal direction to the release position, the stoppers 252 do not block the respective pathways of the tokens 212.

Further Aspect

Figure 19:
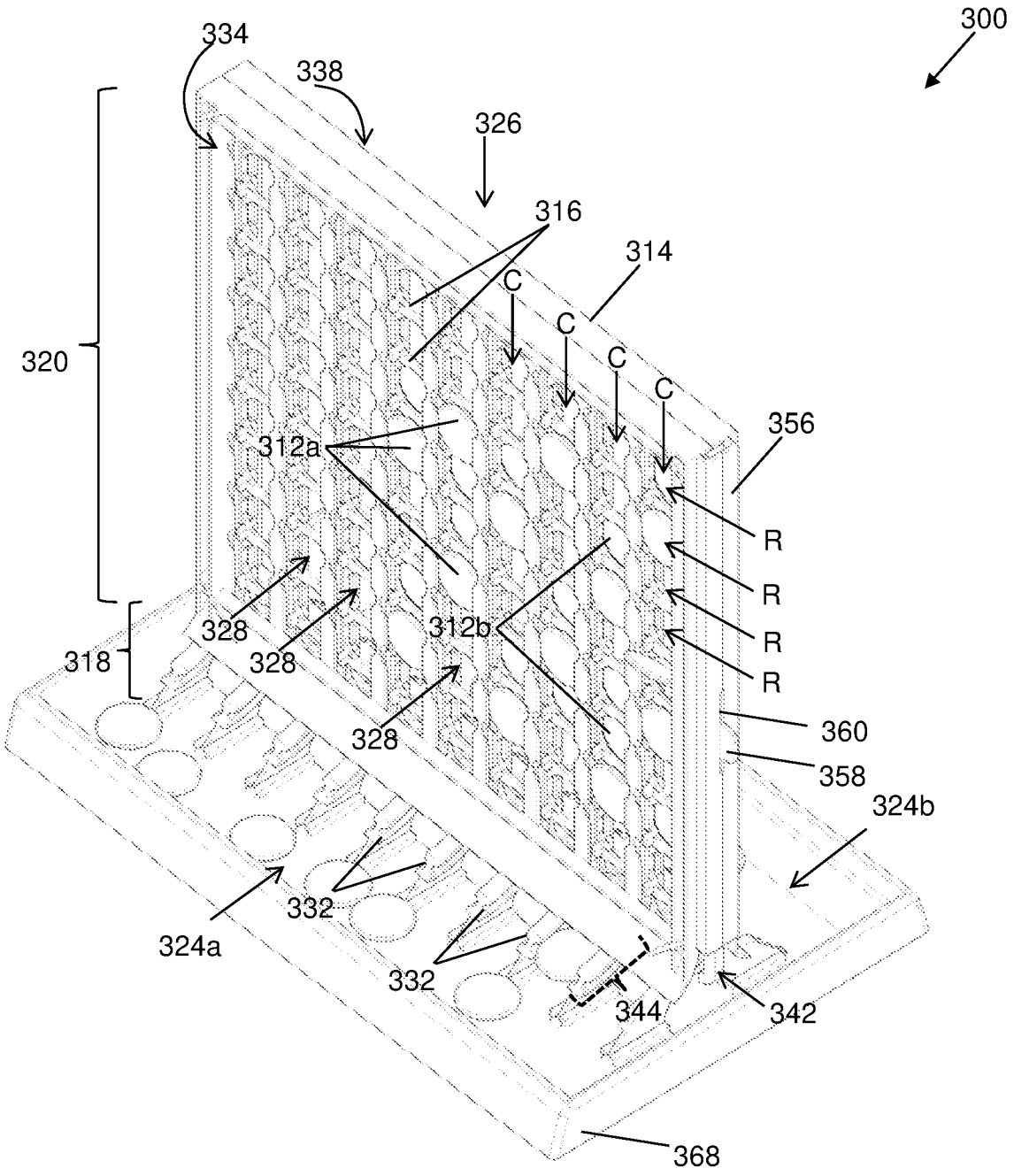
FIG. 19 is a perspective view of a game apparatus according to a further embodiment of the present invention.
Figure 20:
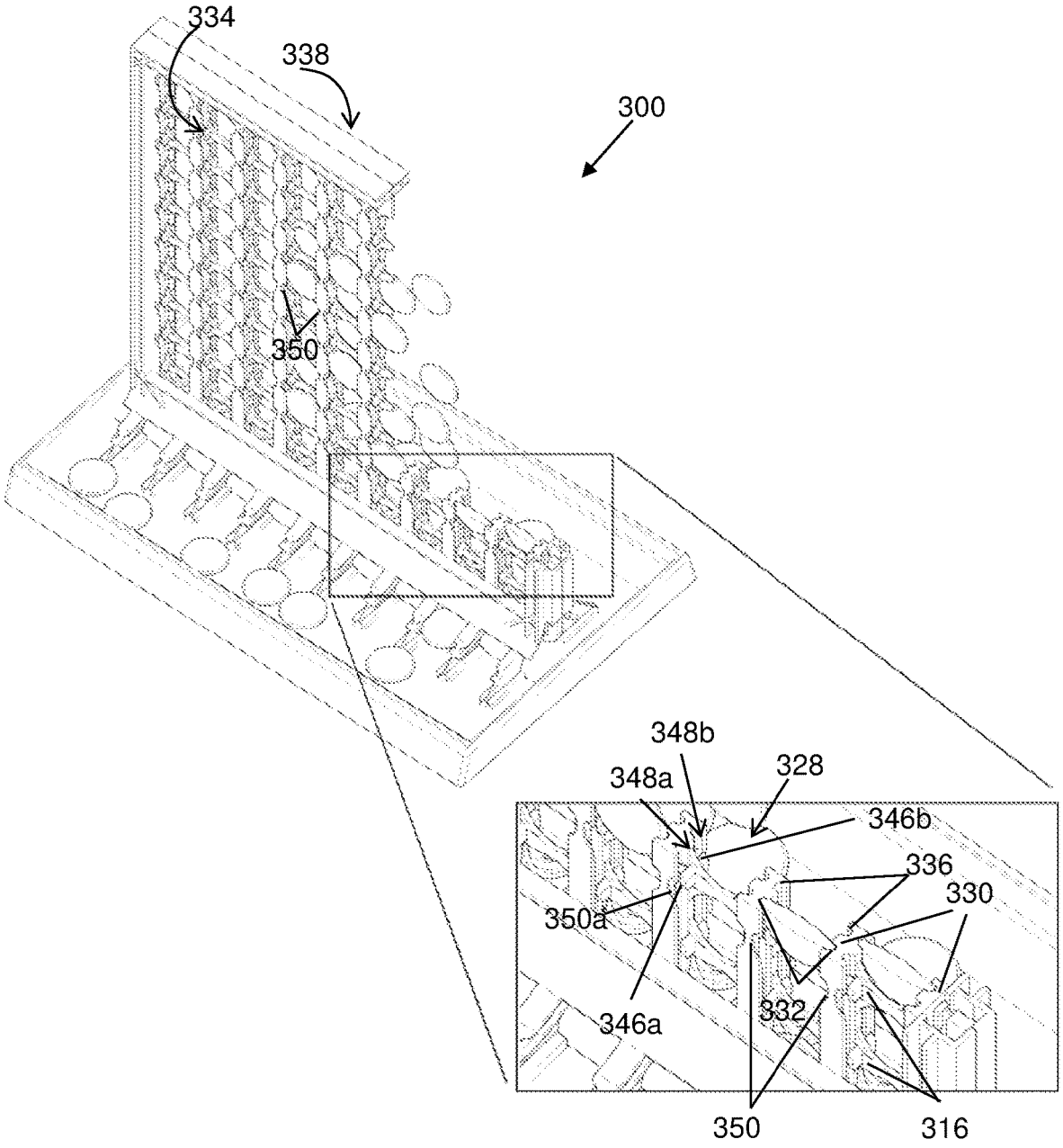
FIG. 20 shows a partially cutaway perspective view and a magnified view of the game apparatus shown in FIG. 19.
Figure 21:
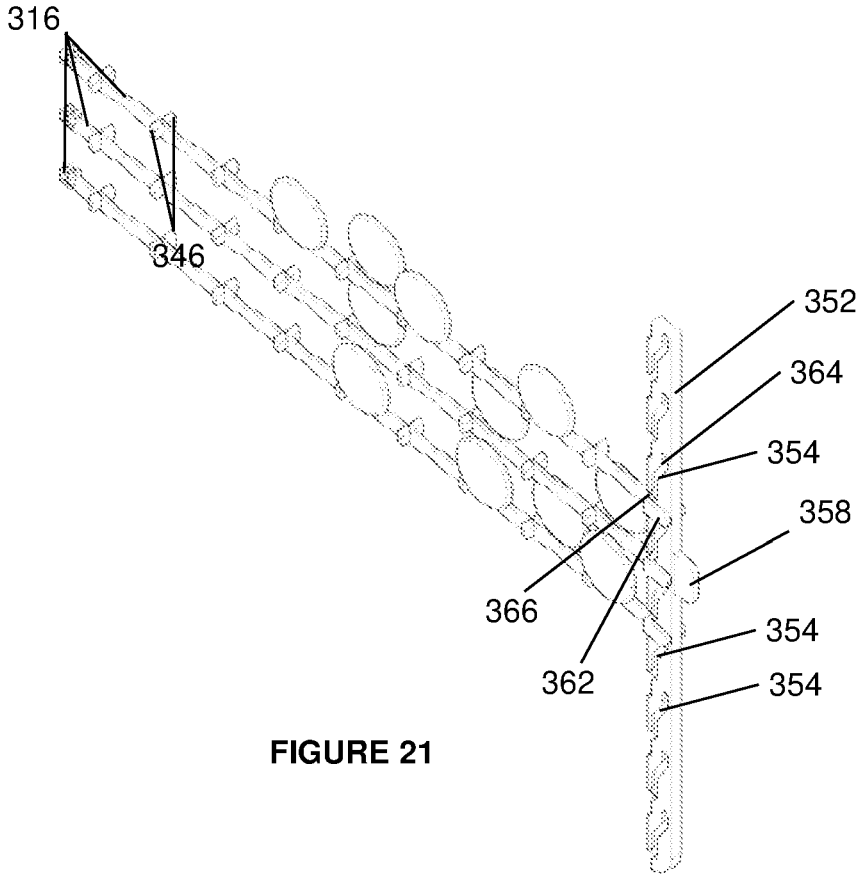
FIG. 21 shows a retainer and control member of the game apparatus shown in FIG. 19.

FIGS. 19 to 21 show an embodiment of a game apparatus 300 according to another aspect of the invention. The apparatus 300 is useful for games such as but not limited to "Go", which involve the use of a plurality of tokens 312 including first tokens 312*a* and second tokens 312*b* visually distinct from the first tokens 312*a*, and placement of the tokens 312 at predefined token receiving positions. In this example, all tokens 312 have the same disc-like shape and configuration.

The apparatus 300 comprises a frame 314 arranged to define a plurality of token receiving positions, and retainers 316 for controllably retaining tokens in respective token receiving positions. The retainers 316 are movable between a first "holding" position wherein the retainers 316 retain the tokens in respective token receiving positions, and a second "release" position wherein the retainers 316 release the tokens from the respective token receiving positions. The frame 314 is also arranged to define multiple pathways along which tokens that have been released from respective token receiving positions can move under force of gravity when the retainers 316 are in the release position.

Like the apparatuses 10, 100 and 200 described above, the frame 314 of the apparatus 300 comprises a base portion 318 and a substantially upright structure 320 that receives the tokens 312 during game play. The apparatus 300 also comprises first 324*a* and second 324*b* token collection zones where first tokens 312*a* and second tokens 312*b*, respectively, may be collected after game play. Traditionally, games such as "Go" involve placing tokens at locations of a square grid on a horizontally-oriented board. In contrast, the frame 314 of the apparatus 300 in this example is arranged to define a substantially vertically oriented grid 326 of grid locations 328, as shown in FIG. 19.

Referring to FIGS. 19 and 20, the grid 326 comprises a plurality of rows "R" and columns "C", thus defining R×C grid locations 328. In this example, the grid 326 has 9×9 grid locations 328; however, it will be appreciated that the grid 326 according to other examples may have any suitable dimensions. The columns C of the grid 326 are defined by substantially parallel upright frame members 330. The rows R of the grid 326 are defined by the retainers 316 extending across the columns C and are spaced apart from each other at regular intervals along a height of the frame 314.

Each column C of the grid 326 accommodates a first pair of opposed grooves 332 that extend across all rows R in a substantially vertical orientation, and a second pair of opposed grooves 336 that extend across all rows R in a substantially vertical orientation. The first pair of grooves 332 are disposed on a first side 334 of the frame 314 and receive the first tokens 312*a*, and the second pair of grooves 336 are disposed on a second opposite side 338 of the frame 314 and receive the second tokens 312*b*.

The first pair of grooves 332 also comprises a directing portion 344 that extends from a bottom end 342 of the frame 314 towards the first collection zone 324*a*. Likewise, the second pair of grooves 336 comprises a directing portion (not shown) that extends from the bottom end 342 of the frame 314 towards the second collection zone 324*b*. The first 332 and second 336 pairs of grooves are each arranged to engage an edge of a token 312 in a manner such that when a token 312 falls under force of gravity, the token is directed towards the relevant first or second collection zone 324*a*, 324*b*. Thus, it will be appreciated that the pathways along which the tokens 312 move are provided by the first 332 and second 336 pairs of opposing grooves.

Each row R of the grid 326 has an adjacent retainer 316. Each retainer 316 comprises an elongate body extending substantially horizontally across the columns C through apertures (not shown) in the upright structures 320. Each retainer 316 also comprises pairs of stoppers 346 disposed at regular intervals along the retainer 316 for retaining tokens 312 at respective token receiving positions, as described in more detail below.

Each grid location 328 comprises first 348*a* and second 348*b* token receiving positions. With reference to the grid location 328 shown in FIG. 15, the first token receiving position 348*a* is defined by a first stopper 346*a* and the first pair of grooves 332. Similarly, the second token receiving position 348*b* is defined by a second stopper 346*b* and the second pair of grooves 336. As shown in FIG. 15, when the retainer 316 is in the holding position, the first stopper 346*a* is disposed in front of a groove of the first pair of grooves 332, and the second stopper 346*b* is disposed in front of a groove of the second pair of grooves 336. The first 348*a* and second 348*b* stoppers thus block the pathway of a token 312 along the respective first 332 or second 336 pairs of grooves and thereby retain the tokens in the token receiving portions associated with the retainer 316.

In order to facilitate placement of a token 312 in a token receiving position 348, the frame 314 comprises a pair of opposing notches 350 provided in the upright frame members 330 at a location generally above the token receiving position 348. The token 312 can be placed directly into the token receiving position 348 by inserting the token 312 through the pair of notches 350 and sliding the token 312 into the respective pair of grooves 332 or 336. Accordingly, unlike the apparatuses 10, 100 and 200, tokens 312 are placed directly into a grid location 328, this being possible if the grid location 328 is unoccupied.

It will be appreciated that during game play, a first player is assigned the first tokens 312*a* for placement in the first token receiving positions 348*a* at the first side 334 of the frame 314, and a second player is assigned the second tokens 312*b* for placement in the second token receiving positions 348*b* at the second side 338 of the frame 314.

Each grid location 328 is arranged such that if one of the first and second token receiving positions 348*a*, 348*b* is already occupied by a token, the presence of a token 312 at the grid location will create a degree of obstruction for a further token 312 to restrict entry of the further token into the grid location. In this way, only one token 312 is received at each grid location 328, consistent with rules for the game "Go". A token 312 can also be removed from a receiving position 348*a* or 348*b* by performing a reverse of the placement manoeuvre described above, such that the token 312 slide out through the associated opposing notches 350. The removal of tokens 312 individually from the frame 314 may be required when playing games such as "Go".

Referring to FIG. 21, the holding and release positions of the retainers 316 will now be described in more detail.

As described above, when a retainer 316 is in the holding position, the pairs of stoppers 346 obstruct the pathway of a token 312 along a respective pair of grooves 332 or 336.

When the retainer 316 is in the release position, the pairs of stoppers 346 move away from the pathway of the token 312, allowing the token 312 to fall along the pair of grooves to a respective collection zone.

Referring to FIGS. 19 and 21, the apparatus 300 in this example further comprises a control member 352 for controlling movement of a plurality of retainers 316. The control member 352 comprises an elongate body and a plurality of tracks 354 provided at regular intervals along the elongate body. Each track 354 comprises a cut-out in the body of the control member 352. The control member 352 is movably mounted in a substantially vertical orientation within a casing 356 at one end of the frame 314. The control member 352 further comprises a control tab 358 attached to the elongated body of the control member 356. The control tab 358 extends through and is movable along a slot 360 in the casing 356. The control member 352 can be selectively moved up and down with respect to the frame 314 by moving the control tab 358 along the slot 360.

Each retainer 316 comprises a track follower 362 at one end, which is movably received in a respective track 354 of the control member 352. Due to the location of the track follower 362 in the respective track 354, movement of the control member 352 in a vertical direction translates to movement of the retainer 316 in a generally horizontal direction. In this example, when the retainer 316 is in the holding position, the track follower 362 of the retainer 316 is positioned in an upper section 364 of the track 354. When the control member 352 is moved upwardly with respect to the frame 314, the track follower 352 moves along the track 354 to a lower section 366, as shown in FIG. 21. Since the lower section 366 is horizontally offset from the upper section 364, the retainer 316 is forced to move in a horizontal direction.

It will be appreciated that since the control member 352 engages respective track followers 362 of all retainers 316 of the apparatus 300, the control member 352 can be used to move all of the retainers 316 simultaneously between the holding and release positions. This avoids the need to individually move the retainers 316 between the holding and release positions.

The apparatus 300 further comprises a tray 368 in which the frame 314 stands. The tray 368 delimits the first 324*a* and second 324*b* collection zones, thus preventing the tokens 312 from scattering too far from the frame 314 when released.

Embodiments of the apparatus 300 may provide the advantage that it is more convenient to play games such as "Go" in situations where there is a greater likelihood of the frame 314 being moved, such as during travel, because the tokens 312 are held in respective token receiving positions until actively released. Further, since the first tokens 312*a* can be placed in the first token receiving positions 348*a* and directed to the first collection zone 324*a*, and the second tokens 312*b* can be placed in the second tokens receiving positions 348*b* and directed to the second collection zone 324*b*, players do not need to sort the tokens into the first and second tokens 348*a*, 348*b* after game play, thus reducing the amount of time between games.

An advantage of embodiments of the apparatuses 10, 200 and 300 described above may arise from the different positioning of first and second tokens during game play. In particular, with the apparatuses 10 and 300, the first tokens and the second tokens are intended to be positioned in different planes. Further, in the apparatus 200, the first tokens and the second tokens are positioned in opposite orientations. Due to these positional variations, it is contemplated that embodiments of the apparatuses 10, 200 and 300 described above could be used by the visually impaired by touching the tokens to determine the positions of the first tokens and the second tokens.

Further Aspect

According to a further aspect of the invention, there is provided a game apparatus that releases tokens from respective pathways by orienting a frame of the game apparatus substantially upside down. In a specific example, the game apparatus is a modified version of the apparatus 10, and therefore the same reference numerals will be used when reference is made to the same features as the apparatus 10.

With reference to FIGS. 1 and 2, in this example, the apparatus has the same features as the apparatus 10 except that this apparatus does not have controllably movable retainers 16 and 68, or directing portions 47*a* and 47*b*. Instead the bottom ends 30 of the channels 24 of this apparatus are closed, for example by a fixed retainer. However, the first and second tokens 12*a*, 12*b* can be released from the channels 24 in a manner that separates the first tokens 12*a* from the second tokens 12*b* by orienting the frame 14 substantially upside down. When the frame 14 is oriented in this manner, the first tokens 12*a* will fall out of the channels 24 under force of gravity via the upper portion 58 of the first pair of rails 40; and similarly, the second tokens 12*b* will fall out of the channels 24 under force of gravity via the upper portion 60 of the second pair of rails 44.

Because the upper portion 58 is on the first side 42 of the frame 14 and inclines away from the second side 46 of the frame 14, the first tokens 12*a* are directed away from the second tokens 12*b* when the frame 14 is oriented upside down. Similarly, because the upper portion 48 is inclined away from the first side 42 of the frame 14, the second tokens 12*b* in this example are also directed away from the first tokens 12*b*.

It will be appreciated that the apparatus of this further aspect of the invention can be implemented as a modified version of the apparatus 200 according to another example. In this example, the apparatus has the same features of the apparatus 200 except that the apparatus does not have pairs of opposing gutters 250 or lower disengaging end portions 228. Instead, the first and second tokens 212*a*, 212*b* are prevented from disengaging from a bottom end of the rails 222 by a retainer, such as a fixed retainer.

To release the first and second tokens 212*a*, 212*b* from the rails 222, the frame 214 can be oriented substantially upside down. Because the first branches 242*a* are inclined away from the second side 244*b* of the frame 214, and the second branches 242*b* are inclined away from the first side 244*a* of the frame 214, first and second branches 242*a*, 242*b* will direct first and second tokens 214 away from each other when the frame 214 is oriented substantially upside down. Specifically, the first tokens 212*a* will fall away from engagement with the rails 222 and be directed by the first branches 242*a* away from the second tokens 212*b*; similarly, the second tokens 212*a*, 212*b* will fall away from the rails 222 and be directed by the second branches 242*b* away from the first tokens 212*a*.

Variations

It will be understood by persons skilled in the art of the invention that many modifications may be made without departing from the spirit and scope of the invention. For example, the first and second tokens can be visually distinguishable from each other by sufficiently visible structural features, such as a central feature or through hole, rather than by colour.

Furthermore, the first tokens and second tokens of various embodiments described above are described as being symmetrical. While symmetrical tokens may provide advantages, such as eliminating the need to be mindful of the orientation of the tokens, in other variations the tokens need not be symmetrical. For example, the first tokens 112*a* shown in FIG. 7 may instead have only one circumferential ridge 150.

As another example, in relation to the apparatus 10 described above, the second 36 and/or third 38 components also need not extend continuously. Further, instead of the second 36 and/or third 38 separating components extending a full length of a respective channel 24, the second 36 and/or third 38 separating components may extend only partially along the channel 24. Alternatively, the second 36 and/or third 38 separating components may not extend along the channel 24, but may instead comprise only the directing portions 47*a* or 47*b*. If the second and/or third components 36, 38 only comprise the directing portion 47*a*, 47*b*, or comprise the directing portion 47*a*, 47*b* and another portion extending partially along the respective channel 24 upwardly of the directing portion 47*a*, 47*b*, another means for guiding a token onto the second or third components 36, 38 may be employed. Such other means may involve keeping the token to a defined side of the channel located directly above the second or third component 36, 38. For example, such means may comprise a projection extending from a face of the token to keep the token to one side of the channel (e.g. by abutting against an inner surface of the plate 80) as the token moves along the channel.

Figure 22:
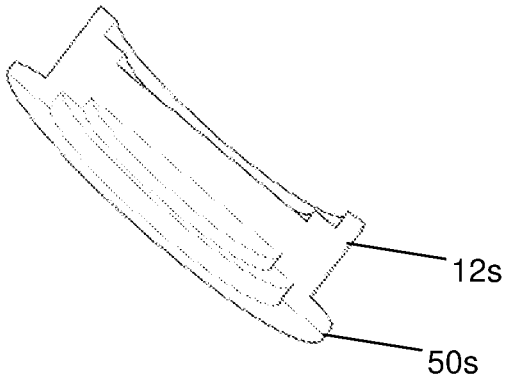
FIG. 22 is a partially cutaway perspective view of a token according to another embodiment of the present invention.

As another example, referring to FIG. 22, such means may comprise a single circumferential ridge 50*s* on one side of the token 12*s*, which remains aligned with the second or third separating component 36, 38, depending on the orientation of the token 12*s*, as the token 12*s* moves along the channel 24. The ridge 50*s* will thus ultimately engage the second or third separating component 36, 38.

Similarly, in relation to the apparatus 100, according to another embodiment the pair of rails 160 may not extend fully along the channel 124. Instead, the pair of rails 160 may only comprise the directing portion 162, or the directing portion 162 and a portion extending contiguously from the directing portion 162 and partially along the channel 124 at a lower end portion of the channel 124. In this regard, the guide walls 164 and 166 will generally retain alignment of one of the pairs of grooves 152, 154 of the first token 112*a* with the pair of rails 160 when the first token 112*a* reaches the pair of rails 160.

In yet another example, the opposing pair of rails 40 and/or 44 described above in relation to the apparatus 10 may instead be replaced by an opposing pair of grooves, and the circumferential groove of the first 12*a* and/or second 12*b* tokens may instead be replaced with a circumferential ridge engageable with the opposing pairs of grooves. Likewise, in relation to the apparatus 100, 200 and 300, rails may be replaced with grooves, and grooves may be replaced with rails.

In yet another example, the apparatus 300 has been described above without reference to a separating mechanism because the apparatus 300 has completely separate first 348*a* and second 348*b* token receiving positions of a grid location 328. However, it is contemplated that in other embodiments, tokens and/or token receiving positions may be arranged in a manner that requires a separating mechanism, such as the separating mechanisms described above in relation to the apparatuses 10, 100 and 200.

In yet a further example, it is contemplated that the separating mechanism of the apparatuses may comprise separating components that have non-structural features. For example, one or more of the separating components may comprise a magnet, such as magnetic guides along the pathways or channels, and a magnetic component at or within the tokens.

In yet another example, the separating mechanism may comprise a pair of opposing guides, wherein one of the guides in the pair is a groove and the other is a rail. In this example, each first token may comprise a ridge part and a groove part configured to engage, respectively, with opposing groove and rail in the pair of guides, to direct the first tokens to the first collection zones.

In yet a further example, the tokens may be movable along the pathways by a force other than gravity, such as but not limited to electromotive force, pneumatic force, and forces produced by a biasing mechanism, such as a spring.

In yet a further example, the apparatus may include a sorting mechanism near an upper portion of the frame for initially sorting the tokens into the first and second tokens upon insertion of the token. The apparatus may also be configured to keep the first and second tokens separate within the channel after initial sorting, before directing the tokens to respective collection zones.

In yet a further example, the apparatus may be configured such that a player's tokens are returned to a side of the frame opposite to the side assigned to the player. In this manner, while each player will still have one of the first and second sets of tokens returned to them, the players' tokens will be "swapped" each game.

In yet a further example, the apparatus may be configured so that majority portion of the retainer(s), such as the elongate portion, are provided on the outside of the frame, with stoppers extending into the channels.

In yet a further example, one or more lights such as LEDs may be externally mounted or embedded into the frame and/or tokens, which may serve to visually distinguish first tokens from second tokens as well as illuminating tokens for game play in low lighting conditions. As another example, light pipes may be mounted on or in the frame on one or both sides to provide light to each player's tokens.

Figure 23:
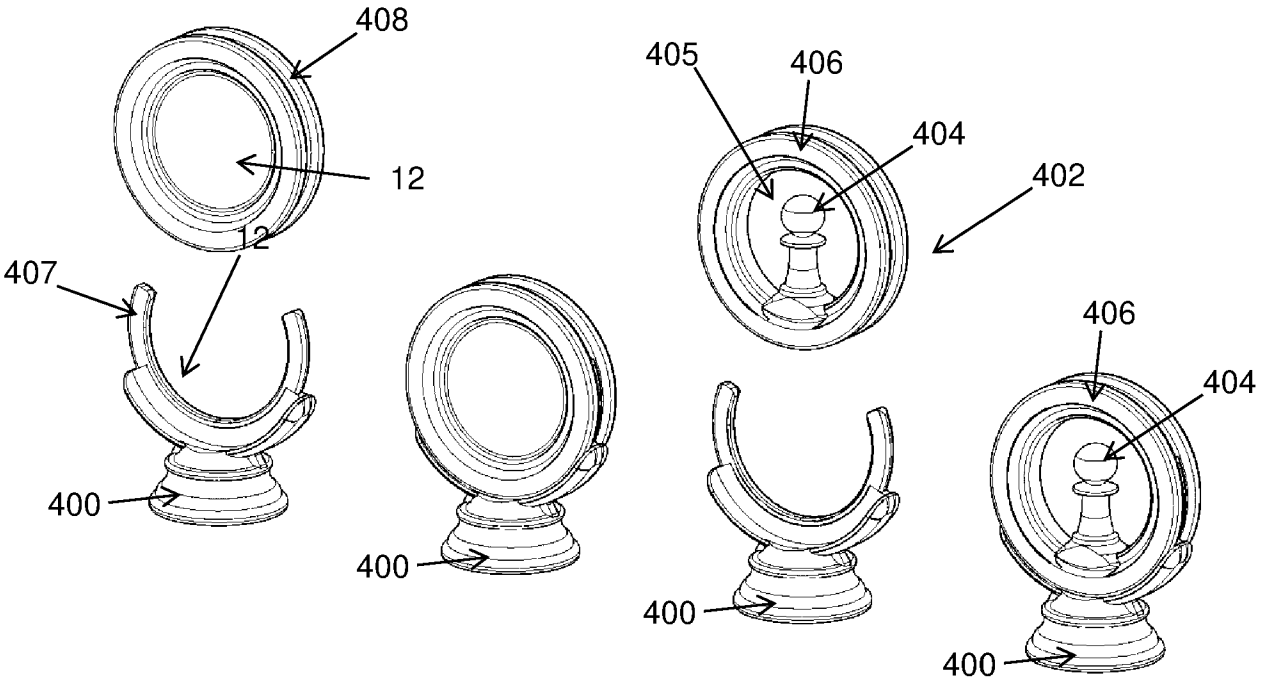
FIG. 23 shows perspective views of a token holder and an alternative token.

As shown in FIG. 23, a token holder 400 may be included to hold a token 12 in a generally upright orientation, for example such that the token lies in a generally vertical plane. In this way, the tokens may be used for other purposes, for example as pieces in other games such as draughts where tokens are disposed horizontally and chess where tokens are disposed substantially vertically. By incorporating game relevant indicia into the token 12 the gameplay may be diversely altered or hybridised within the vertical board game matrix or within other game formats by applying rules that may be associated with the indicia tokens. As shown in FIG. 23, a token 402 is configured so as to include a chess piece 404 surrounded by a rim 406. It will be understood that the token 402 not only has a space 408 defined by its circumferential groove but it also has a space 405 between the chess piece 404 and the rim 406 that has an added advantage in that the risk of choking is reduced should the token become lodged in a person's windpipe in any orientation.

In this example, the token 12, 402 is arranged to engage with the token holder 400 by providing the token holder with an arcuate portion 407 that engages and/or interlocks with a circumferential groove 408 provided in the token 12, 402. For example, the arcuate portion 407 may be arranged to engage with the circumferential groove 408 in a snap-fit manner.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention. Similarly, the word "include" or variations such as "includes" or "including" is used in the preceding description and claims which follow in an inclusive sense, i.e. to specify the presence of the stated features but not to preclude the presence or addition of further features in various embodiments of the invention.

The invention claimed is:

1. A game apparatus comprising:

a plurality of tokens including first tokens and second tokens;

a frame arranged to define multiple pathways along which the tokens are capable of moving under force of gravity;

a retainer arranged to controllably retain the tokens relative to the pathways, the retainer movable between:

(a) a first position wherein the retainer retains the tokens relative to the pathways; and (b) a second position wherein the tokens are allowed to move under force of gravity; and a separating mechanism arranged to direct the first tokens towards a first collection zone and to direct the second tokens towards a second collection zone, the separating mechanism comprising a first separating component associated with each first token and at least one second separating component associated with the frame, wherein when the retainer is in the second position, the first and the at least one second separating components cooperate so as to direct the first tokens away from the second collection zone and towards the first collection zone.

2. The game apparatus of claim 1, wherein the first and the at least one second separating components are configured as complementary engagement portions of the first tokens and the frame, respectively.

3. The game apparatus of claim 1, wherein the frame is arranged to define a plurality of substantially parallel channels arranged side by side, wherein each channel comprises at least one pathway.

4. The game apparatus of claim 2, wherein each second separating component comprises a pair of opposing guides associated with a respective channel, the pair of opposing guides configured to engage the first tokens in a manner that allows the first tokens to move along the pair of opposing guides by force of gravity.

5. The game apparatus of claim 4, wherein each pair of opposing guides comprises:

a portion that extends along the respective channel;

opposing rails, and each first token comprises a circumferential groove engageable with the opposing rails;

opposing grooves, and each first token comprises a circumferential ridge engageable with the opposing grooves; or a sloped portion extending towards the first collection zone so that the first tokens can move under force of gravity to the first collection zone, wherein the sloped portion transitions from a generally vertical orientation to a generally horizontal orientation towards the first collection zone, such that the first tokens transition to a generally horizontal orientation while moving along the sloped portion, wherein the sloped portion comprises an end located above a token stacking region, wherein a first token is capable of falling off the end of the sloped portion and onto the token stacking region in a substantially horizontal orientation, and subsequent first tokens are capable of falling off the end of the sloped portion and stacking on top of the first token already in the stacking region, and wherein the token stacking region comprises a sloped bed on top of which the first tokens are stacked.

6. The game apparatus of claim 3, wherein the separating mechanism comprises at least one third separating component associated with the frame, the at least one third separating component arranged to cooperate with the second tokens so as to direct the second tokens to the second collection zone.

7. The apparatus of claim 6, wherein each third separating component comprises a pair of opposing guides, wherein each second token also comprises the first separating component, wherein the first separating component of each second token and the at least one third separating component are configured as complementary engagement portions, wherein each third separating component comprises a pair of opposing rails and each second token comprises a circumferential groove engageable with the opposing rails, further comprising a common engagement portion defined between the second separating component and a third separating component in the same channel, wherein a portion of a first token engaged with the second separating component engages the common engagement portion, and a portion of a second token engaged with the third separating component engages the common engagement portion, so as to enable stacking of the first and second token within the same channel.

8. The game apparatus of claim 1, wherein the first and second tokens are structurally different, and the second tokens are configured to be incapable of engaging the at least one second separating component, wherein a third separating component is located underneath a respective channel to catch and direct the second tokens towards the second collection zone, and wherein each third separating component comprises a pair of sloped opposing rails and each second token comprises a circumferential ridge arranged to be received by the pair of opposing rails to direct the second tokens to the second collection zone.

9. The game apparatus of claim 8, wherein first and second tokens within the same channel move along the same pathway.

10. The game apparatus of claim 1, wherein each second separating component comprises a single guide rail defining a pathway along which the first and second tokens can move, and wherein the first separating component comprises a recess in a face of each first and second token, the recess capable of engaging the single guide rail.

11. The game apparatus of claim 1, wherein the first and second tokens are structurally the same, and the game apparatus is arranged to guide first tokens such that the first tokens engage with the at least one second separating component and to guide second tokens such that the second tokens do not engage with the at least one second separating component, and wherein at least one third separating component is located underneath a respective channel to catch and direct the second tokens towards the second collection zone.

12. The game apparatus of claim 1, wherein the retainer comprises an elongate member insertable within the frame, the elongate member comprising a plurality of stoppers extending from the member for obstructing the pathways of the tokens.

13. The game apparatus of claim 1, comprising one or more further retainers arranged to temporarily retain one or more tokens at predefined locations along the pathways, each further retainer movable between:

a first position where the retainer retains the tokens at the predefined locations along the pathways; and a second position where the retainer allows the tokens to move from the predefined locations under force of gravity.

14. The game apparatus of claim 1, wherein the game apparatus is connectable in endwise relationship to an adjacent game apparatus to define an enlarged game apparatus.

* * * * *